US009328538B2

(12) United States Patent
Conti

(10) Patent No.: US 9,328,538 B2
(45) Date of Patent: May 3, 2016

(54) SECURITY CONTAINER FOR SMALL ARTICLES

(75) Inventor: Brian V. Conti, Matthews, NC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 967 days.

(21) Appl. No.: 13/415,269

(22) Filed: Mar. 8, 2012

(65) Prior Publication Data

US 2012/0228290 A1 Sep. 13, 2012

Related U.S. Application Data

(60) Provisional application No. 61/450,692, filed on Mar. 9, 2011.

(51) Int. Cl.
*E05B 65/00* (2006.01)
*E05B 73/00* (2006.01)

(52) U.S. Cl.
CPC ..... *E05B 73/0023* (2013.01); *E05B 73/0017* (2013.01); *E05B 73/0058* (2013.01)

(58) Field of Classification Search
USPC ..... 70/57, 57.1, 58, 63; 206/1.5, 308.2
See application file for complete search history.

(56) References Cited

U.S. PATENT DOCUMENTS 5,417,319 A * 5/1995 Chalberg et al. ..... 70/63
5,760,689 A * 6/1998 Holmgren ..... 70/63
6,125,668 A * 10/2000 Belden, Jr. ..... 70/63
6,676,175 B2 * 1/2004 Jaeb et al. ..... 292/116
6,926,164 B1 * 8/2005 Broadhead et al. ..... 70/57.1
7,451,627 B2 * 11/2008 Horngren et al. ..... 70/57.1
7,453,370 B2 11/2008 Marsilio et al.
7,598,861 B2 * 10/2009 Belden et al. ..... 340/545.6
7,963,131 B2 * 6/2011 Zhang et al. ..... 70/57.1
2004/0163430 A1 * 8/2004 Belden, Jr. ..... 70/57.1
2005/0172682 A1 * 8/2005 Holmgren ..... 70/57.1
2005/0268672 A1 * 12/2005 Fraser et al. ..... 70/57.1
2011/0215683 A1 * 9/2011 Nakasuji ..... 70/63

* cited by examiner

*Primary Examiner* — Christopher Boswell

(74) *Attorney, Agent, or Firm* — Nelson Mullins Riley & Scarborough LLP

(57) ABSTRACT

A security container for holding a product. The container includes a jacket having a cavity, a sleeve receivable in the cavity, and a chamber in the sleeve for holding the product. The sleeve moves within the cavity between a position where a user can access the chamber and a position where they cannot access the chamber. A locking mechanism secures the sleeve against movement when in the locked condition and permits movement thereof when unlocked. An alarm mechanism is provided that is simultaneously activated when the locking mechanism is locked and deactivated when the locking mechanism is unlocked. The locking mechanism includes a magnetic locking member movable by a dedicated magnetic key to unlock the mechanism. The security container is adjustable in length to accommodate products of different sizes. The container is of a diminutive size in that it is capable of fitting into a man's dress shirt pocket.

19 Claims, 16 Drawing Sheets

SECURITY CONTAINER FOR SMALL ARTICLES

BACKGROUND OF THE INVENTION

1. Technical Field

This invention relates generally to packaging and containers. More particularly, the invention relates to lockable containers. Specifically, the invention relates to a lockable container that includes a sleeve that holds a product and slides into a jacket to prevent access to the product. An alarm mechanism is provided that is armed simultaneously when a locking mechanism is locked and is disarmed simultaneously as the locking mechanism is unlocked.

2. Background Information

Many stores sell articles of merchandise that are expensive. In such instances, it frequently is necessary to display these valuable articles in such a way that would-be thieves are deterred from stealing the article or are hindered in doing so. If the article of merchandise is fairly large, it is relatively easy for a store to detect if a thief is removing the same from a display or attempting to get the article past a security system such as security gates at the exit to the store. Additionally, larger articles provide ample opportunity for the store to attach security tags, such as RFID tags, to the article itself or to its packaging. Numerous other security measures have been invented to protect these larger articles including specialized securement systems which prevent tampering with packaging, alarmed tethers to secure articles to displays etc.

Smaller articles of merchandise are far more problematic for retailers simply because of their size. Smaller articles are relatively easy for a would-be thief to slip into their clothing or into a pocket or purse. It is extremely difficult to attach security measures such as RFID tags to these smaller items and the articles can be unsuitable for tethering to displays.

There is therefore a need in the art for a security device that can be used to deter would-be thieves from stealing smaller articles of merchandise.

BRIEF SUMMARY OF THE INVENTION

The device of the present invention is a security container for holding a product. The container includes a jacket having a cavity, a sleeve receivable in the cavity, and a chamber in the sleeve for holding the product. The sleeve moves within the cavity between a position where a user can access the chamber and a position where they cannot access the chamber. A locking mechanism secures the sleeve against movement when in the locked condition and permits movement thereof when unlocked. An alarm mechanism is provided that is simultaneously activated when the locking mechanism is locked and deactivated when the locking mechanism is unlocked. The locking mechanism includes a magnetic locking member movable by a dedicated magnetic key to unlock the mechanism. The security container is adjustable in length to accommodate products of different sizes. The container preferably is of a diminutive size in that it is capable of fitting into a man's dress shirt pocket.

BRIEF DESCRIPTION OF THE SEVERAL VIEWS OF THE DRAWINGS

The preferred embodiments of the invention, illustrative of the best mode in which Applicant contemplates applying the principles, are set forth in the following description and are shown in the drawings and are particularly and distinctly pointed out and set forth in the appended claims.

DETAILED DESCRIPTION OF THE INVENTION

Figure 6:
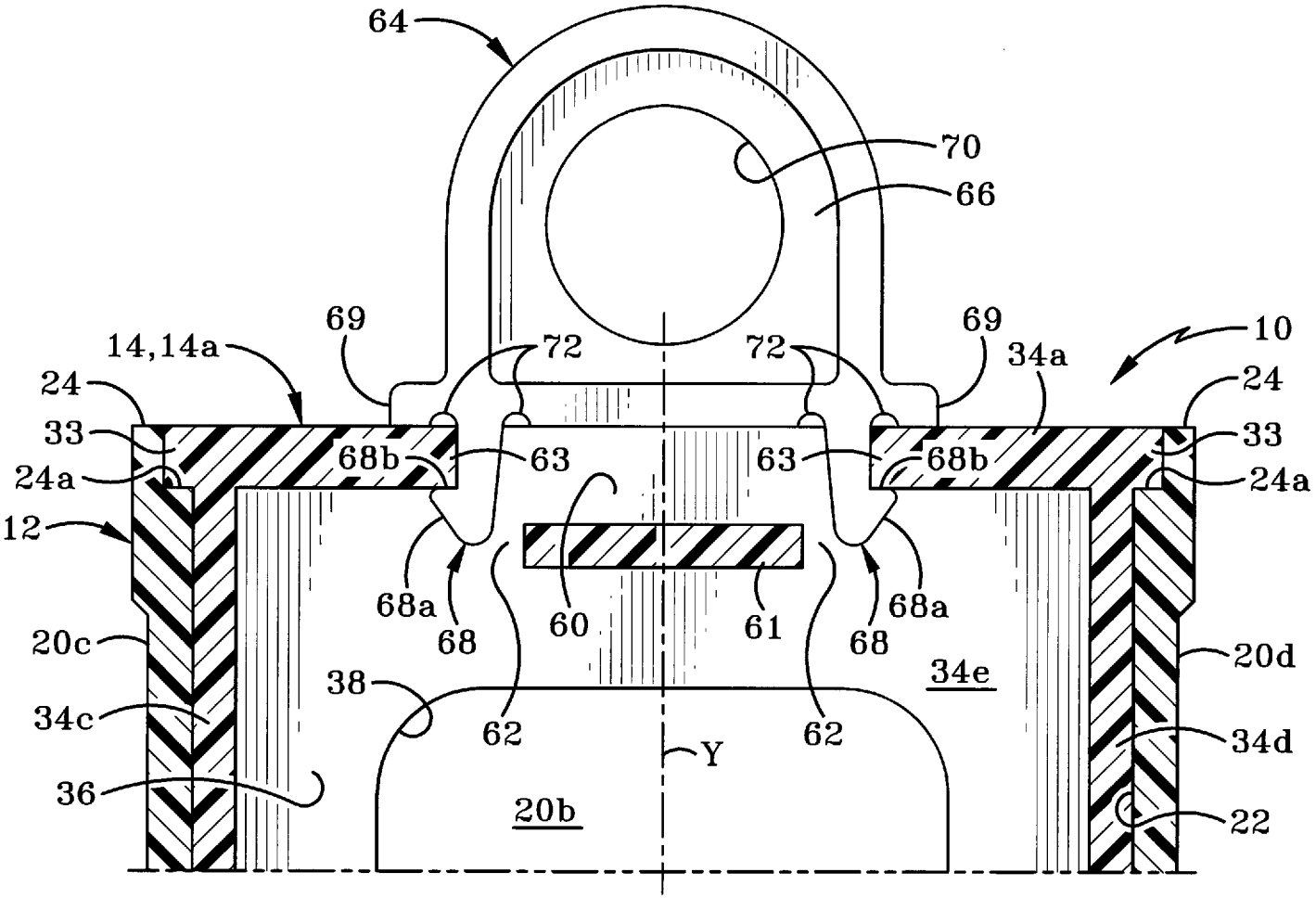
FIG. 6 is a front cross-sectional view of the engaged sleeve and jacket taken along line 6-6 of FIG. 1, showing the hanger member engaged with the top wall of the sleeve.

Referring to FIGS. 1-12 there is shown a first embodiment of a security container in accordance with the present invention, generally indicated at 10. Security container 10 comprises an outer jacket 12 and an inner sleeve 14 that are engageable with each other to surround and protect a product and to provide security thereto to prevent theft of that product. Particularly, outer jacket 12 and inner sleeve 14 are slidably engageable with each other along a longitudinal axis "Y" (FIG. 6). Both jacket 12 and sleeve 14 preferably are molded from a rigid plastic material although other suitable materials such as metals may also be utilized to manufacture the same.

Figure 10:
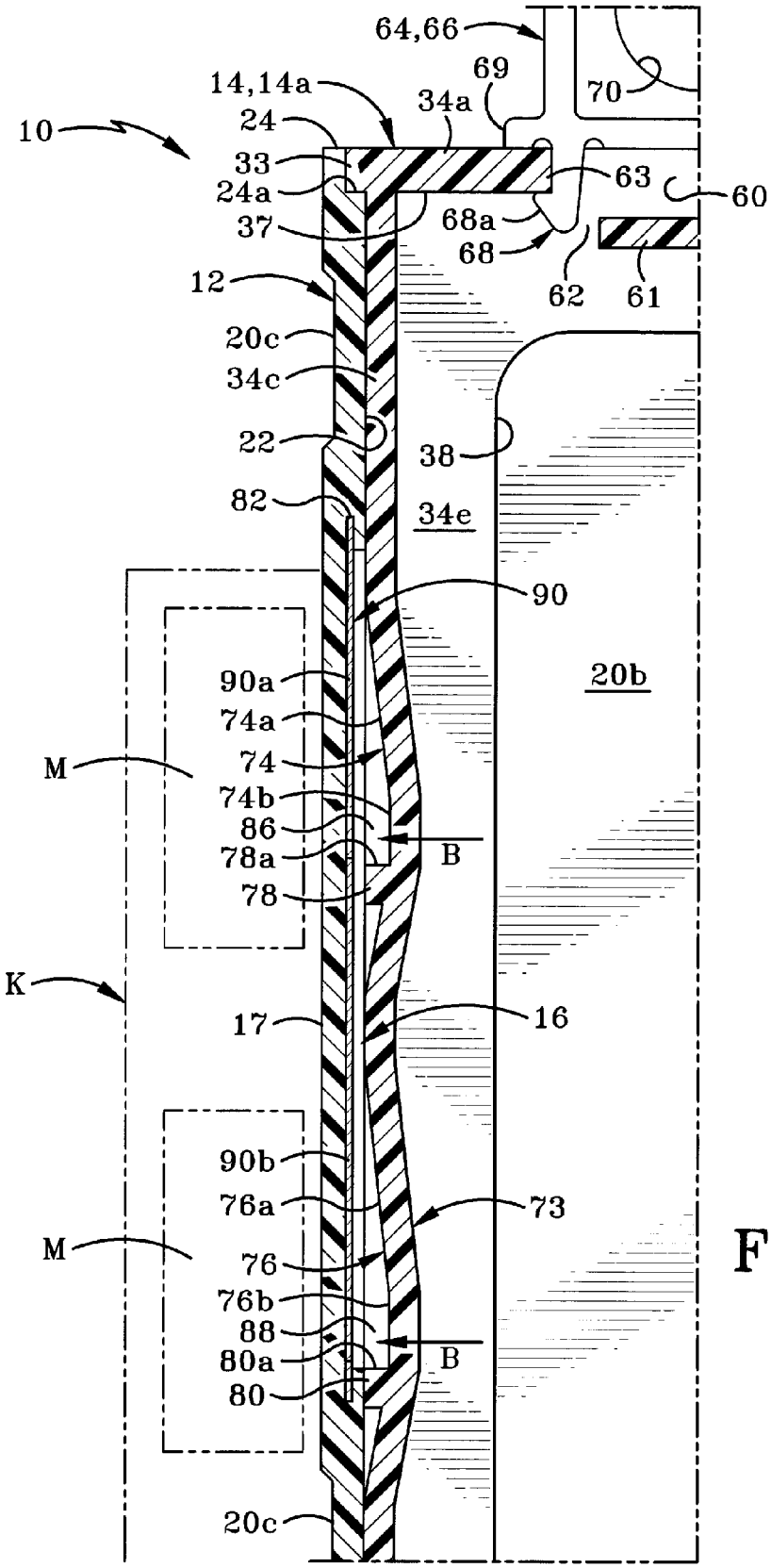
FIG. 10 is a left-side cross-sectional view of the engaged sleeve and jacket taken along line 9-9 of FIG. 1 and showing a magnetic key engaged with the security container and the locking mechanism in an unlocked condition.
Figure 11:
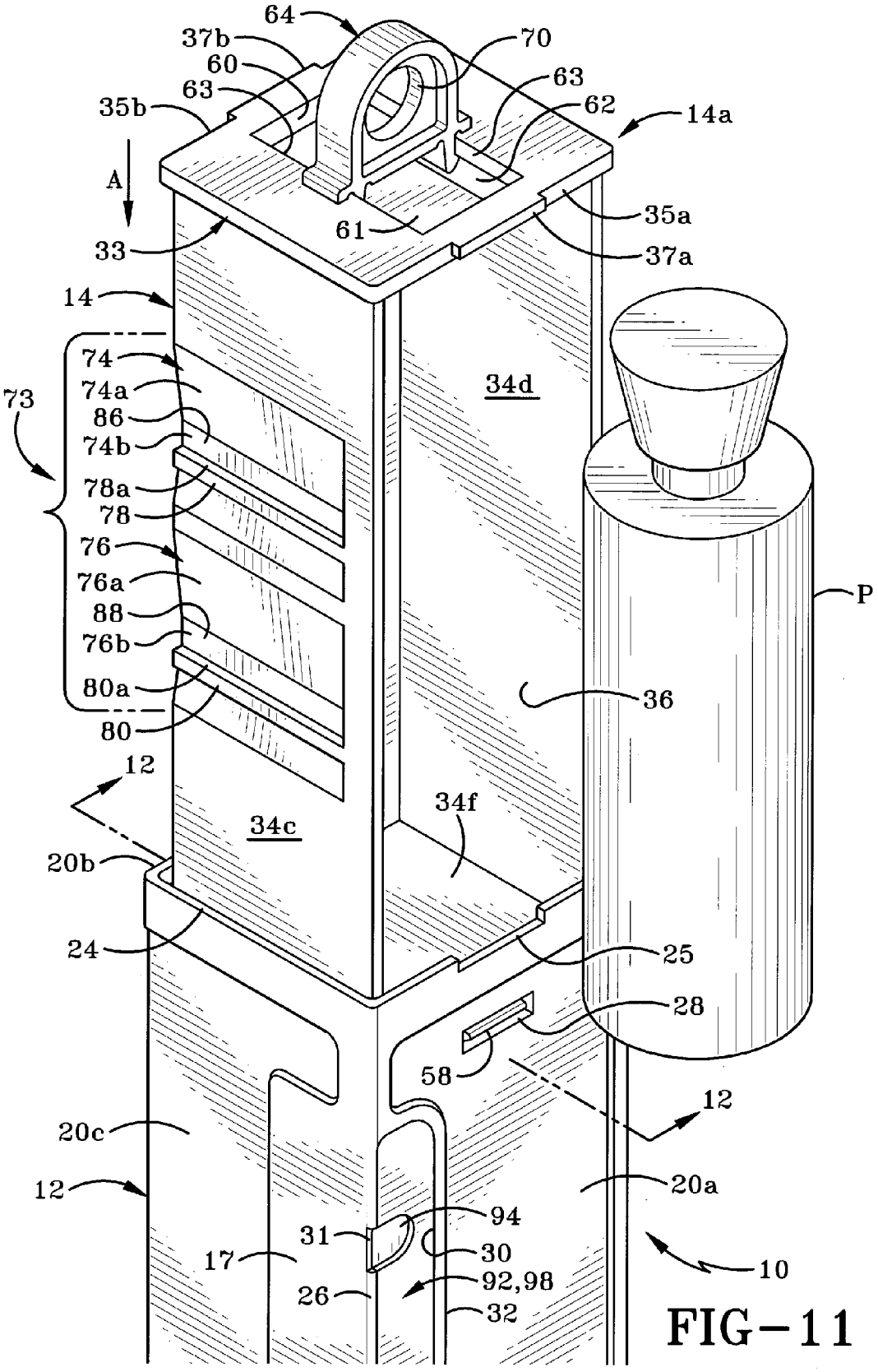
FIG. 11 is a perspective front view of the security container in a first or open position and showing a product being inserted into the chamber of the sleeve.

As will be described in detail hereinafter, sleeve 14 is configured to carry small articles of merchandise, such as product "P" (FIG. 11) and it should be understood that security container 10 preferably is of a size that is small enough to fit into a man's dress shirt pocket. Particularly, product "P' is a small product that is relatively expensive and is difficult to display without putting it at risk for theft. An example of the type of product "P" that could be secured inside security container 10 is a small perfume bottle or a small box containing a perfume bottle. Sleeve 4 is slidably movable into a cavity 22 (FIG. 2B) defined by jacket 12. When product "P" is engaged in a chamber 36 (FIG. 2A) in sleeve 14, sleeve 14 is moved further inwardly into cavity 22 (FIG. 2B) defined by jacket 12 to block access to the chamber 36. When sleeve reaches a certain position in cavity 22, a locking mechanism 16 within container 10 is moved from an unlocked condition to a locked condition. This substantially prevents further longitudinal movement of sleeve 14 relative to jacket 12 and simultaneously causes an alarm mechanism 18 within security container 10 to move from an unarmed condition to an armed condition. Alarm mechanism 18 may be of any type but preferably is a three-way alarm that is triggered if a would-be-thief attempts to break into security container 10 or if they try to pass through a secured exit to a store with security container 10. Once security container 10 is locked by locking mechanism 16 and alarm mechanism 18 is activated, security container 10 is then able to be displayed for sale of the product "P" therein. Security container 10 may be placed on a shelf of a display or may be hung from a hang tag, as will be described further herein. When the consumer takes the security container 10 through the checkout at a store, the store employee will disarm alarm mechanism 18 utilizing a specially configured key "K" (FIG. 10). The disarming of alarm mechanism 18 will simultaneously unlock locking mechanism 16. Inner sleeve 14 is then able to slide outwardly from cavity 22 of jacket 12 and product "P" may then be removed from chamber 36 (FIG. 2A) of sleeve 14. Security container 10 is then able to be utilized to secure another product for display and sale.

Still referring to FIGS. 1-12 and especially FIG. 2B, all of the components which are incorporated into security container 10 and the manner in which they interact will now be described in greater detail.

Figure 2B:
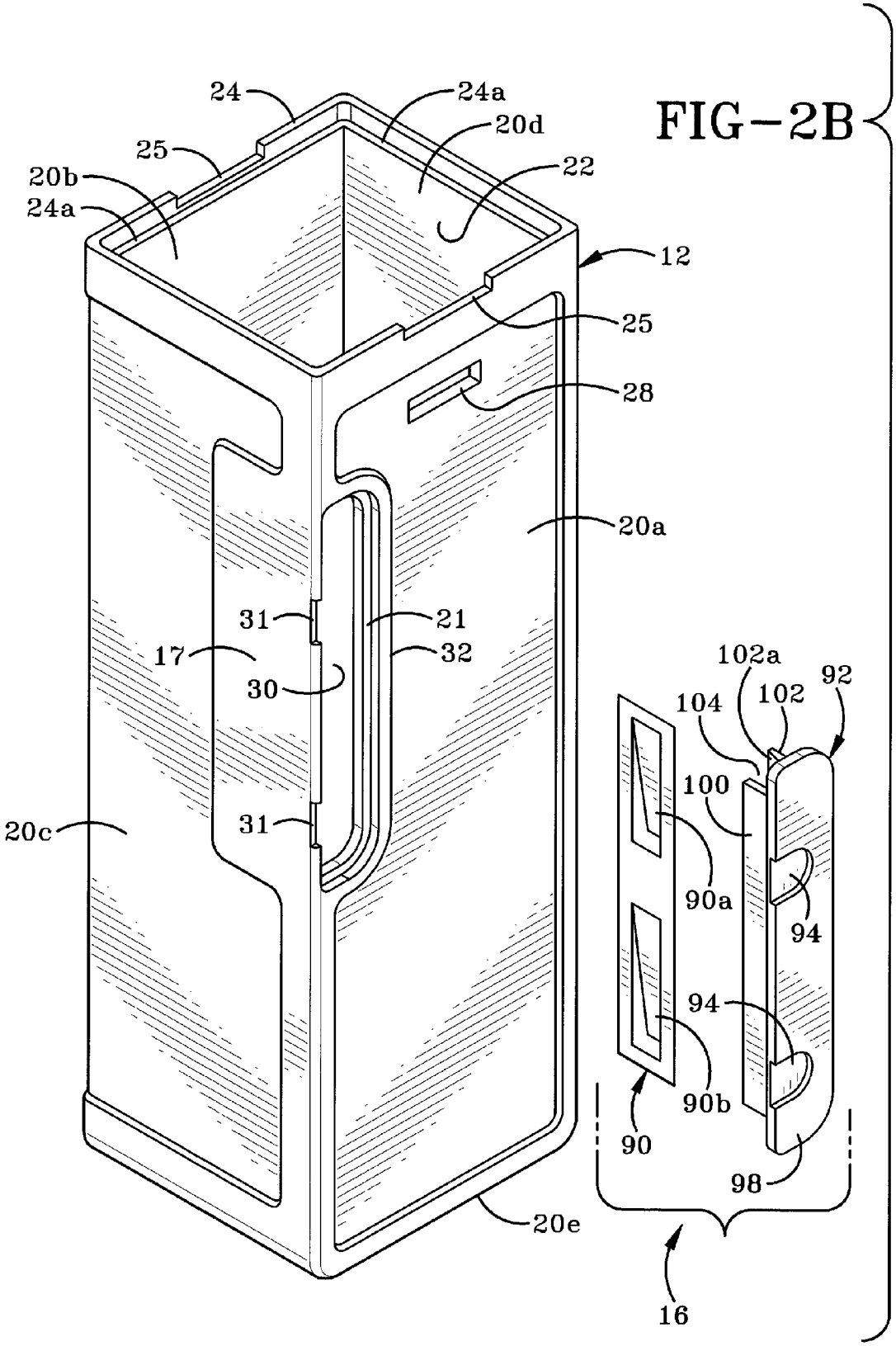
FIG. 2B is an exploded perspective front view of the outer jacket of the security container of FIG. 1.
Figure 3:
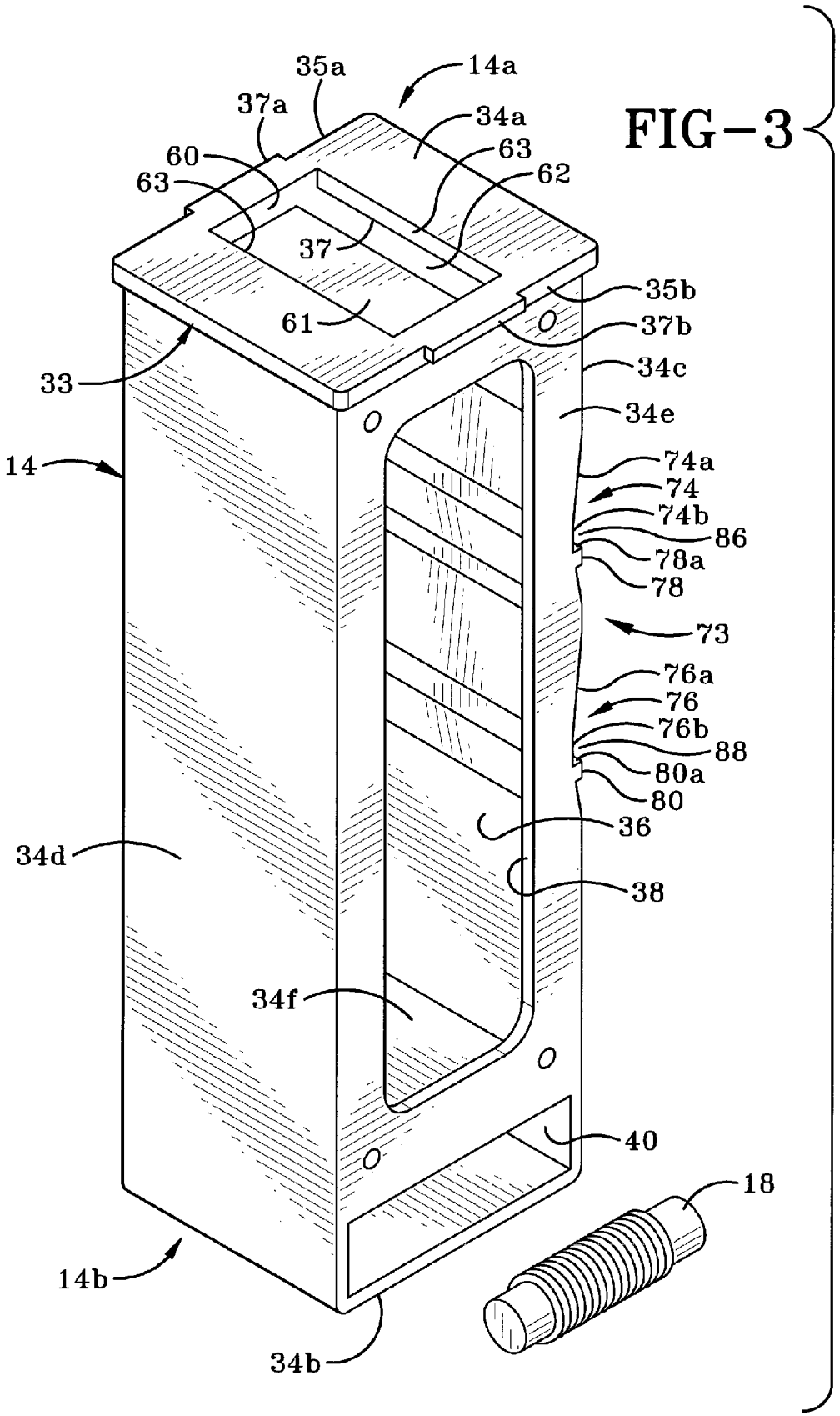
FIG. 3 is an exploded perspective rear view of the inner sleeve of the security container of FIG. 1 shown without the hanger member.

Outer jacket 12 includes a front wall 20*a*, a back wall 20*b*, a left side wall 20*c*, a right side wall 20*d* and a bottom or end wall 20*e* (FIG. 3). It should be understood that the terms "front", "back", "left", "right", "top", "upper", and "bottom" are used only to refer to the orientation of the components as shown in the drawings. The actual security container 10 may be used in any orientation. Walls 20*a*-20*e* bound and define a cavity 22. Front wall 20*a*, back wall 20*b*, and left and right side walls 20*c*, 20*d* terminate in an upper edge 24 that bounds and defines an opening (unnumbered) to cavity 22. A shoulder 24*a* is slightly recessed a distance inwardly from the edge 24. Security container 10 has a longitudinal axis "Y" which extends from upper edge 24 of jacket 12 through to bottom wall 20*e* thereof. Each wall 20*a*-20*d* extends substantially parallel to longitudinal axis "Y" and bottom wall 20*e* and edge 24 are disposed at right angles thereto. FIG. 2B also shows that edge 24 of jacket 12 defines two opposed notches 25, one in the front wall 20*a* and one in the rear wall 20*b*. The purpose of notches 25 will be described further herein.

It will be understood that at least some or all of back wall 20*b* preferably is made from a transparent material so that a portion of the interior chamber 36 (FIG. 2A) of sleeve 14 of security container 10 may be seen through an aligned window 38 (FIG. 3) of sleeve 14. Back wall 20*b* may, alternatively, be made from a non-transparent or opaque material along with the rest of the security container 10 so that the interior of the security container 10 is not visible to the consumer. Still further, all of the walls other than those that cover the locking mechanism 16 and alarm mechanism 18 may be made from transparent materials. It is desirable that at least the regions of the security container which include the locking mechanism 16 and alarm mechanism 18 are not transparent to that the exact nature of those components cannot be examined by would-be thieves.

Front wall 20*a* of jacket 12 meets left side wall 20*c* thereof along a longitudinally extending corner 26. Front wall 20*a* defines a slot 28 (FIG. 2B) and an aperture 30 therein. Slot 28 preferably is oriented generally at right angles to longitudinal axis "Y", although it may be oriented differently without departing from the scope of the present invention. Preferably, slot 28 is generally rectangular in shape and is located a short distance inwardly from edge 24. Aperture 30 is generally D-shaped, is longitudinally aligned and situated adjacent corner 26. Preferably, one or more notches 31 are defined in corner 26 adjacent aperture 30 and spaced a distance from each other. Front wall 20*a* further defines a shoulder 21 which is also generally D-shaped and projects for a distance inwardly into aperture 30. Preferably, aperture 30 is bounded by a ridge 32 on front wall 20*a* that originates in corner 26 proximate left side wall 20*c*, extends horizontally for a distance toward right side wall, turns downwardly and extends for a distance toward bottom wall 20*e* and then turns again toward left side wall 20*c* and extends to corner 26. Ridge 32 assists in correctly positioning the specially designed magnetic key "K" on a locator 92 that is engaged in aperture 30, as will be hereinafter described. The correct positioning of the key K" ensures locking mechanism 16 is able to be disengaged when necessary.

Figure 1:
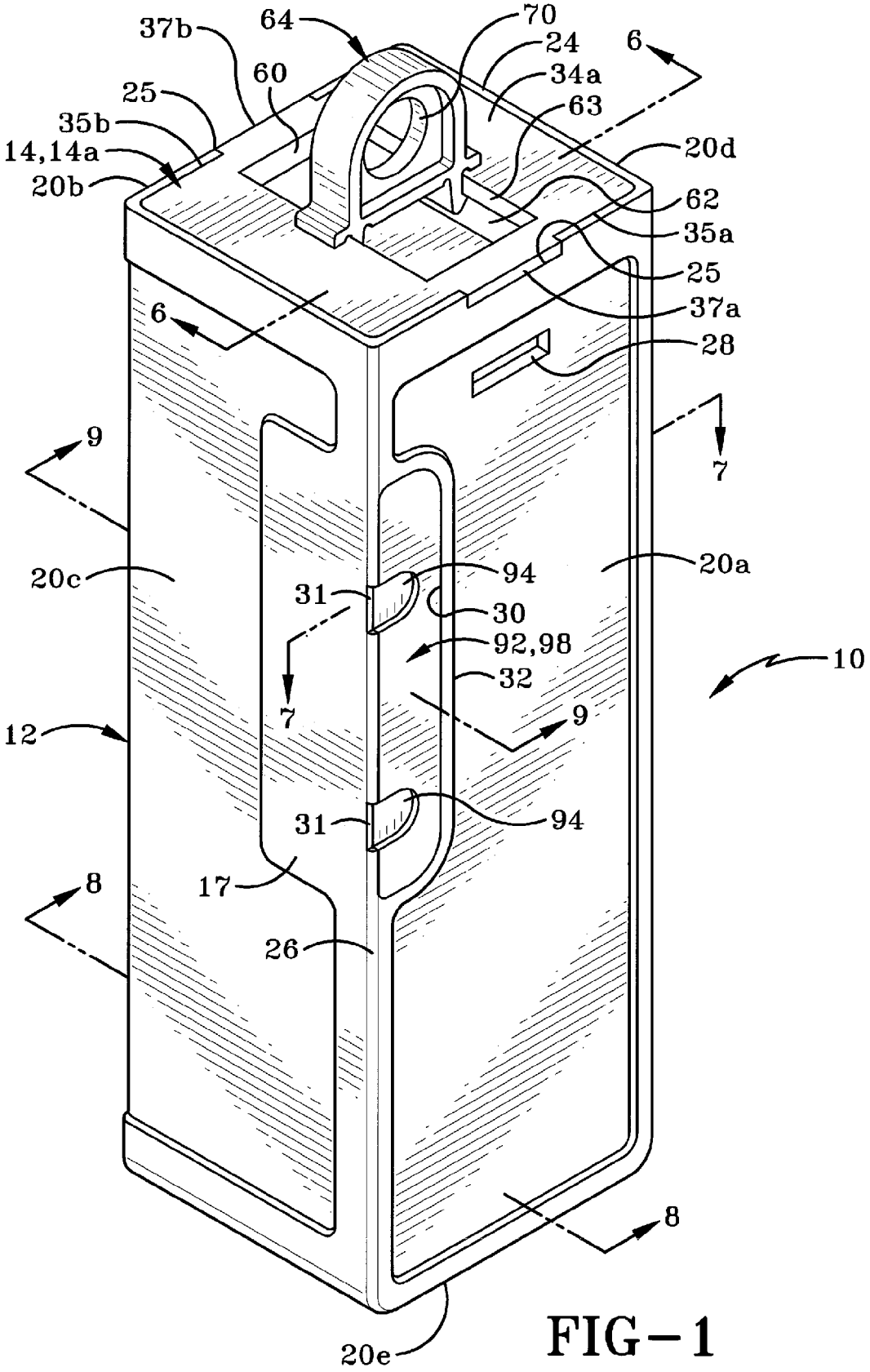
FIG. 1 is a perspective view of a first embodiment of a security container in accordance with the present invention shown in a locked condition and including a hanger member for suspending the container from a display rod.
Figure 2A:
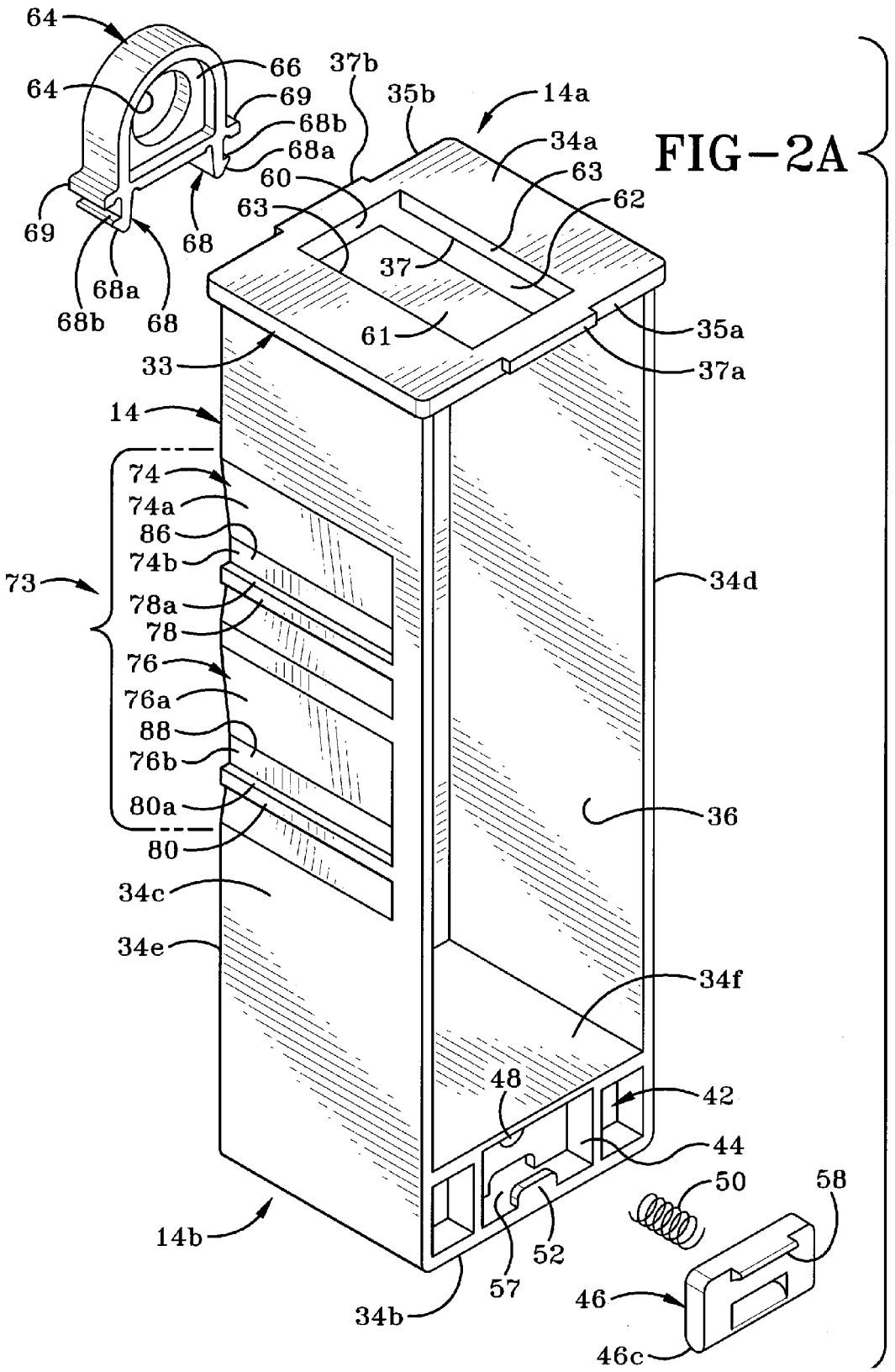
FIG. 2A is an exploded perspective front view of the inner sleeve of the security container of FIG. 1.

Referring to FIGS. 2A & 3, inner sleeve 14 comprises a top or end wall 34*a*, a bottom or end wall 34*b*, a left side wall 34*c*, a right side wall 34*d*, and a back wall 34*e*. An intermediate wall 34*f* is disposed between top wall 34*a* and bottom wall 34*b*. Intermediate wall 34*f* is substantially parallel to top and bottom walls 34*a*, 34*b* and is positioned a short distance above bottom wall 34*b*. Top wall 34*a*, intermediate wall 34*f*, left side wall 34*c*, right side wall 34*d* and back wall 34*e* bound and define a chamber 36 for retaining product "P" therein. Top wall 34*a* further includes a peripheral lip 33 (FIG. 6) which is configured to abut shoulder 24*a* when sleeve 14 is fully inserted into cavity 22 of jacket 12. Top wall 34*a* further includes front and back edges 35*a*, 35*b* and a pair of opposed flanges 37*a*, 37*b* project outwardly from edges 35*a*, 35*b*. Flanges 37*a*, 37*b* are configured to be complementary in position, size and shape to notches 25 in upper edge 24 of jacket 12. When sleeve 14 is locked into jacket 12, flanges 37*a*, 37*b* interlockingly engage in notches 25 to effectively prevent lateral motion between jacket 12 and sleeve 14.

As indicated previously, back wall 34*e* of sleeve preferably defines window 38 therein that is elongate and extends longitudinally along back wall 34*e*. Window 38 is configured to align with the transparent region of back wall 20*b* of jacket 12, if provided. When security container 10 contains product "P" therein, the product "P" will be visible through the aligned transparent region of back wall 20*a* and window 38. It will be understood that window 38 may be omitted from sleeve 14 and/or back wall 20*b* may be non-transparent. In this instance, a product information sheet could be applied to the exterior surface of jacket 12 to indicate the type of product "P" retained within security container 10.

In accordance with a specific feature of the present invention, a compartment 40 is defined between intermediate wall 34*f*, bottom wall 34*b* and a front wall portion 42 of sleeve 14. Compartment 40 is designed to hold the components of the three-way alarm mechanism 18 and all components related to the operation thereof. So, for example, compartment 40 includes components such as a printed circuit board, capacitors, batteries, transistors, and any suitable EAS tag or RFID tag or any other alarm activating or indicating device. It will be understood by those skilled in the art that security container 10 may be provided with a sound generating device that forms part of the alarm mechanism 18. If that is the case, then a speaker grille (not shown) will be provided in an appropriate location on one or more of the walls of jacket 12. Security container 10 may also be provided with a LED light to indicate the status of alarm mechanism 18. As such, a light pipe may be provided on one of the walls of jacket 12 and a LED will be operationally engaged therewith. Although not illustrated herein, it will be understood that alarm mechanism 18 is operationally engaged to locking mechanism 16 by appropriate circuitry. Alarm mechanism 18 will be triggered if an attempt is made to open security container 10 or take security container 10 through a store exit, without deactivating alarm mechanism using the specially designed magnetic key "K". With respect to sleeve 14, a rear wall portion (not shown) may also be sonically welled to intermediate and bottom walls 34*f*, 34*b* of sleeve 14 to seal off access to compartment 40 after the alarm mechanism components have been inserted into the same. The positioning of compartment 40 ensures that a would-be thief cannot access the alarm mechanism components in any way after sleeve 14 is engaged with jacket 12.

In accordance with another specific feature of the present invention, front wall portion 42 of sleeve 14 is configured to define a depression 44 therein that is shaped to receive a complementary catch 46. Depression 44 is positioned so that when sleeve 14 is moved within cavity from a first closed position (FIG. 1) to a second open position (FIG. 11), at least a portion of depression 44 will align with slot 28.

Catch 46 is illustrated in greater detail in FIGS. 2A, 4, 5, and 8. Catch 46 is seated in depression 44 and includes a front surface 46*a* which is configured to abut an interior surface of front wall 20*a* of jacket 12 and a back surface 46*b* which is configured to abut those regions of front wall portion 42 which define depression 44. Front wall portion 42 of sleeve 14 further defines a generally circular recessed region 48 as part of depression 44. A coil spring 50 is seated in recessed region 48 and extends therefrom and into an upper recess 56 in back wall 46*b* of catch. Spring 50 is biased to urge catch 46 outwardly from depression 44 and toward the interior surface of front wall 20*a* of jacket 12, as will be hereinafter described. A protrusion 52 extends outwardly from a bottom region front wall portion 42 and into depression. Protrusion is complementary to a lower slot 54 (FIG. 4) defined in back surface 46*b* of catch 46. A channel 57 is defined between protrusion 52 and a longitudinally extending region of front wall portion 42 which defines depression 44. Channel 57 is configured to receive a rounded bottom edge 46*c* of catch 46 therein. Channel 57 and bottom edge 46*c* are complementary in curvature and bottom edge 46*c* is retained within channel 57 in such a manner that bottom edge 46*c* pivots within channel 57 about an axis that is disposed at right angles to longitudinal axis "Y". When catch 46 is positioned in depression 44, protrusion 52 enters slot 54 and retains catch 46 in depression 44.

Figure 4:
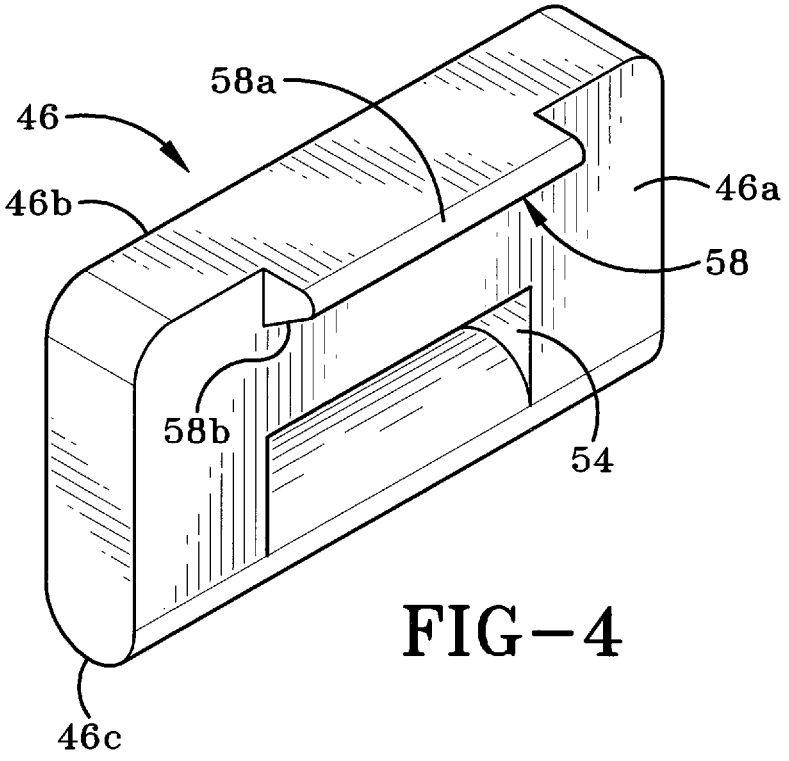
FIG. 4 is a front perspective view of a catch used for latching the outer jacket and the inner sleeve together to prevent the sleeve from fully disengaged from the jacket.
Figure 5:
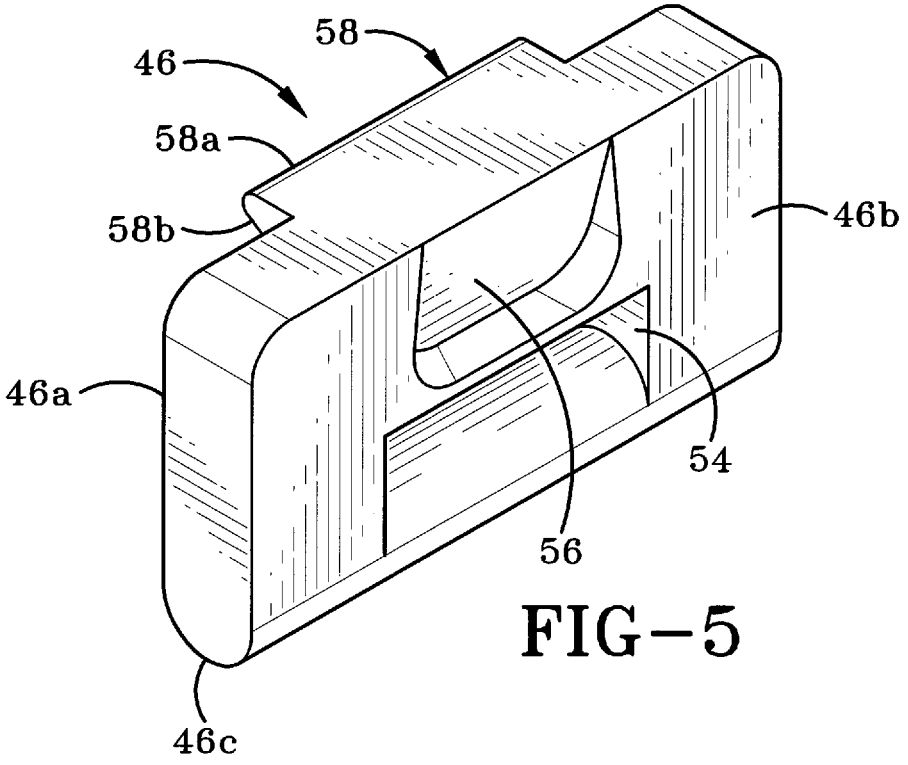
FIG. 5 is a rear perspective view of the catch of FIG. 4.

As best seen in FIGS. 2A & 4, catch 46 includes a tapered projection 58 that extends outwardly from front surface 46*a* thereof. Projection 58 is complementary to slot 28 in front wall 20*a* of jacket 12. Since spring 50 is biased to urge the upper region of catch 46 forwardly toward the interior surface of front wall 20*a*, when slot 28 aligns with projection 58 when sleeve 14 slides upwardly within cavity 22 of jacket 12, curved bottom edge 46*c* of catch 46 will rotate in channel 57 in the direction "D" and projection 58 will be urged into slot 28. When this occurs, all longitudinal motion between sleeve 14 and jacket 12 will be substantially prevented and sleeve 14 will be substantially prevented from being completely withdrawn from cavity 22 and disengaging from jacket 12. Furthermore, until projection 58 is pushed back into cavity 22 to a sufficient degree to cause an outermost tip 58*a* of projection 58 to clear the interior surface of front wall 20*a*, sleeve 14 and jacket 12 remain in the position shown in FIG. 11. When projection 58 is pushed inwardly to clear slot 28, sleeve 14 may be slid in a first direction to disengage it from jacket 12, or in a second direction to close off access to chamber 36.

In accordance with yet another feature of the present invention, a hanger member 64 is detachably engageable with an attachment means on one of the sleeve 14 and jacket 12 to enable security container 10 to be hung from a display rod (not shown) in much the same way as a hang tag. In the attached figures, hanger member 64 is shown being detachably securable to an attachment means provided in top wall 34*a* of sleeve 14. It should be understood, however, that the same type of attachment means for hanger member could be provided in bottom wall 20*e* of jacket 12 without departing from the scope of the present invention.

Top wall 34*a* of sleeve 14 extends between left side wall 34*c*, right side wall 34*d* and back wall 34*e*, and extends for substantially the entire width of left and right side walls 34*c*. The attachment means includes a depression 60 (FIG. 2A) defined in the exterior surface of top wall 34*a* and a recessed wall 61, which forms the bottom of depression 60. Recessed wall 61 is spaced a distance inwardly from and parallel to top wall 34*a*. A pair of spaced apart, parallel and aligned channels 62 is defined in top wall 34*a* and each channel 62 is disposed between one of the side edges of recessed wall 61 and the associated adjacent edge 63 of top wall 34*a*. The orientation of channels 62 is at right angles to longitudinal axis "Y" and in a direction extending from front edge 35*a* to back edge 35*b* of top wall 34*a*. (It will be understood that any other orientation of depression 60 and channels 62 may be utilized without departing from the scope of the present invention.)

Hanger member 64 is configured to be selectively engageable with channels 62. Hanger member 64 includes a generally U-shaped region 66 and a pair of legs 68 that extend downwardly and outwardly from a lower end of the U-shaped region 66. Hanger member 64 may, instead, comprise a region 66 that is of a different shape, such as a square or a rectangular region, without departing from the scope of the invention. An aperture 70 is defined in region 66 and this aperture 70 is provided so that hanger member 64 may receive a display rod (not shown) therethrough. Each leg 68 of hanger member 64 is generally J-shaped and includes a hooked end having an angled face 68*a* and a flat region 68*b*. Angled face 68*a* enables the hooked end to slide more readily into one of channels 62. Flat region 68*b* is oriented so as to contact the interior surface of top wall 34*a* proximate edge 63 when hooked end is received through channel 62. Hanger 64 further includes a flange member 69 which extends horizontally outwardly from the base of the U-shaped region 66 and is configured to contact an exterior surface of edge region 63. A gap (unnumbered) is thus defined between flat region 68*b* of J-shaped hook and flange member 69. One or more arcuate grooves 72 are provided in hanger 64 in the region where flange members 69 originate in U-shaped region 66. Grooves 72 make it possible for legs 68 to be flexed during insertion thereof into channels 62, and to be flexed when legs 68 are removed therefrom. When hanger 64 is snap-fitted into channels 62, each edge 63 of top wall 24*a* is received in one of the unnumbered gaps between flat region 68*b* and flange member 69.

Figure 7:
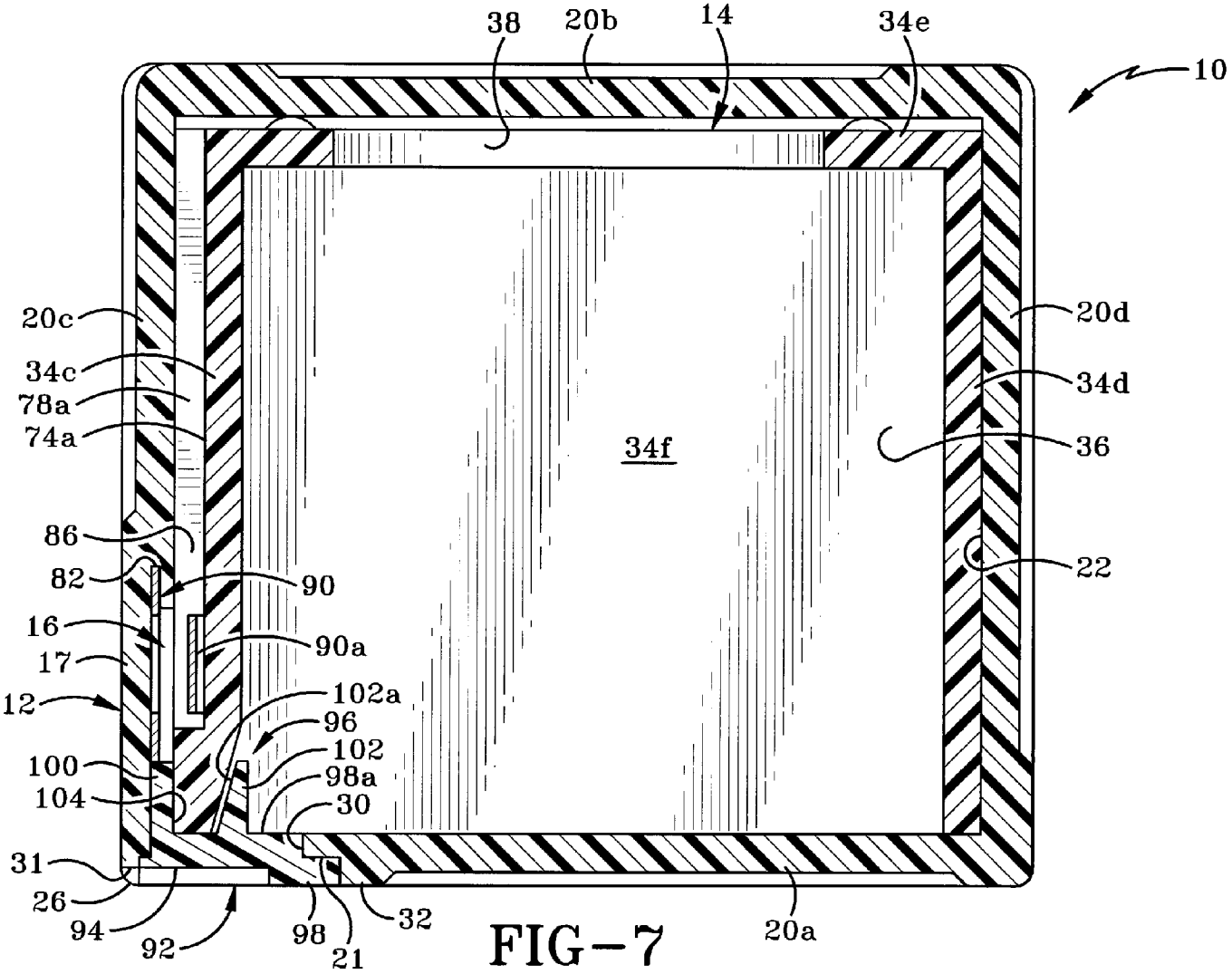
FIG. 7 is a top cross-sectional view of the engaged sleeve and jacket taken along line 7-7 of FIG. 1, showing the locator guide walls engaging the sleeve and keeping the same in the correct alignment with respect to the jacket's inner surface.
Figure 8:
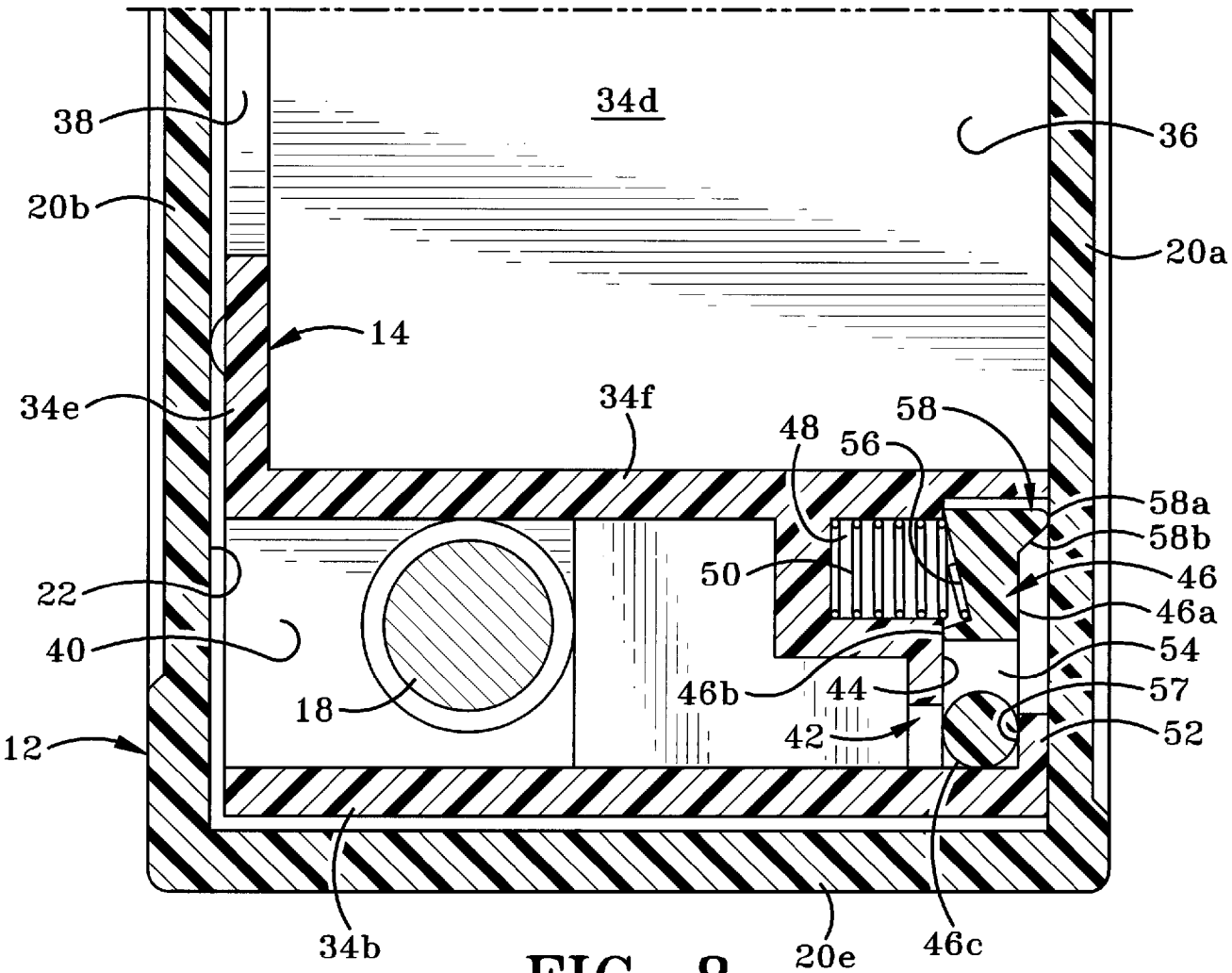
FIG. 8 is a left-side cross-sectional view of the engaged sleeve and jacket taken along line 8-8 of FIG. 1, showing the catch and the compartment housing the alarm mechanism.
Figure 9:
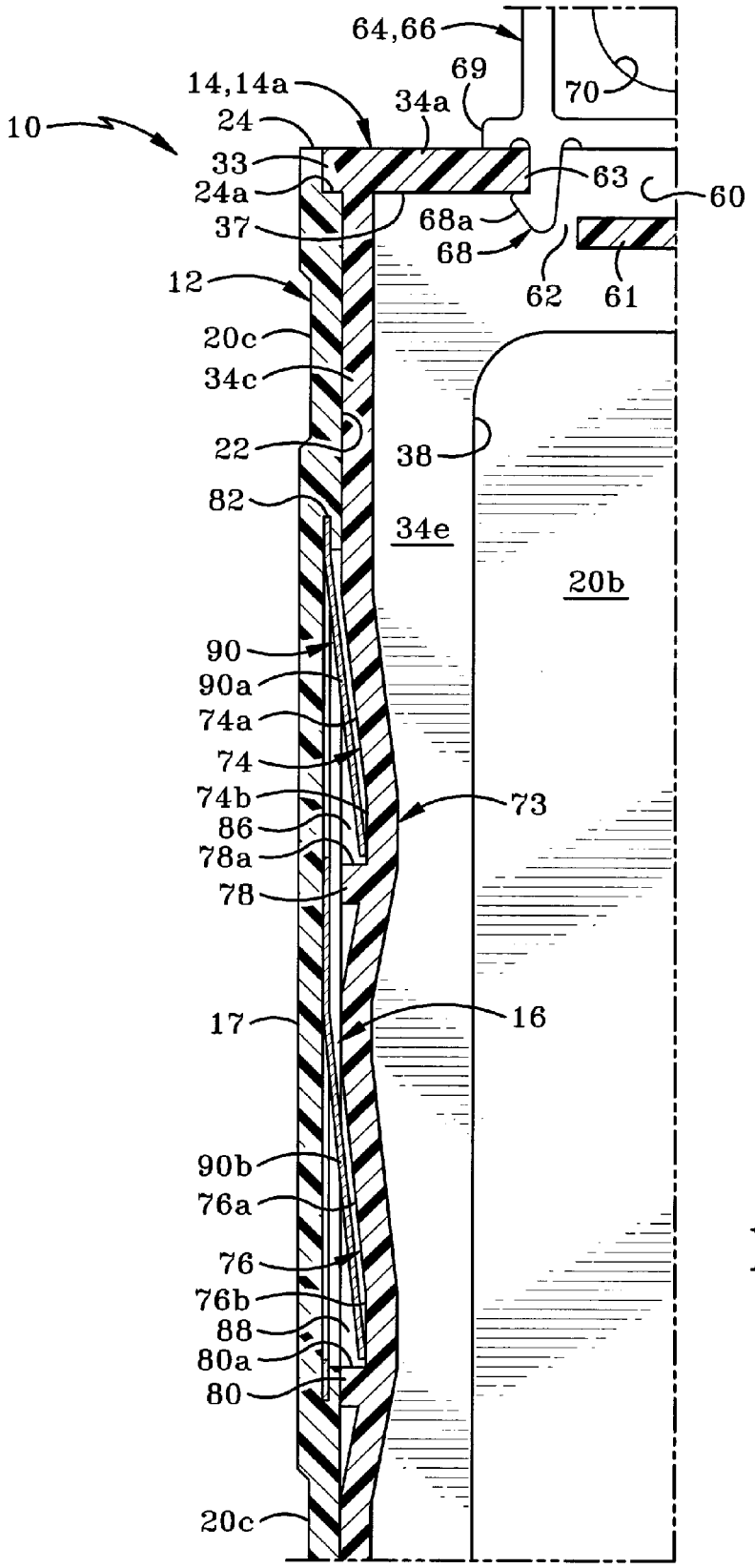
FIG. 9 is a left-side cross-sectional view of the engaged sleeve and jacket taken along line 9-9 of FIG. 1 and showing the locking mechanism in a locked condition.

As indicated previously, security container 10 also contains a locking mechanism 16. Locking mechanism 16 is of a type similar to that disclosed in U.S. Pat. No. 7,453,370 to Marsilio, the entire disclosure of which is incorporated herein by reference. Specifically, as shown in FIG. 9, locking mechanism 16 comprises an engagement area 73 provided on left side wall 34*c* of sleeve 14, a spring clip 90 provided on jacket 12, and a locator 92 provided on an exterior surface of jacket 12. The engagement area 73 includes two shallow contoured regions 74, 76 formed into left side wall 34*c*, approximately midway between top wall 34*a* and intermediate wall 34*f*. The shape of the contours is shown in FIGS. 2A, 7 & 9. A first horizontal ridge 78 is disposed between the first contoured region 74 and the second contoured region 76. A second horizontal ridge 80 is disposed at the lower end of second contoured region 76. The interior surface of left side wall 20*c* of jacket 12 is provided with a first horizontal slit 82 (FIG. 10) and a second horizontal slit 84 spaced a distance downwardly therefrom. When security container 10 is fully locked (as will be described hereinafter) first slit 82 is generally disposed adjacent an uppermost end of first contoured region 74 and second slit 84 is generally disposed adjacent a lowermost end of second contoured region 76 and proximate second ridge 80. This is illustrated in FIG. 9. A first pocket 86 is formed between first contoured region 74 and inner surface of left side wall 20*c* and a second pocket 88 is formed between second contoured region 76 and inner surface of left side wall 20*c*.

Referring to FIG. 2B and in accordance with a specific feature of the present invention, spring clip 90 is a substantially planar member 90*c* manufactured from a magnetic material and includes first and second arms 90*a*, 90*b* which are spring-biased outwardly out of alignment with the planar member 90*c*. Both of jacket 12 and sleeve 14 are manufactured from a nonmetallic material, or may be manufactured from a metallic material that is nonmagnetic. Contoured region 74 includes an inclined face 74*a*, a flat face 74*b*, and terminates in a horizontal face 78*a*. Contoured region 76 includes an inclined face 76*a*, a flat face 76*b*, and terminates in a horizontal face 80*a*. First and second pockets 86, 88 are complementary sized and shaped to receive first and second arms 90*a*, 90*b* of spring clip 90 therein when locking mechanism 16 is activated and is moved to a locked position. First and second ridges 78, 80 are provided to engage the ends first and second arms 90*a*, 90*b* to arrest the longitudinal movement of sleeve 14.

Locator 92 is provided to serve two functions. Firstly, locator 92 indicates the location on security container 10 for positioning the magnetic key "K" to move locking mechanism 16 from a locked condition to an unlocked condition. Secondly, locator 92 acts as a guide to keep the sleeve 14 correctly aligned with jacket 12 during sliding motions of the sleeve 14. This enables sleeve 14 to readily and easily move between a first position where sleeve 14 extends outwardly from cavity 22 and a user is able to access the chamber 36, and a second position where sleeve 14 is retained within cavity 22 to a sufficient degree that a user is unable to access chamber 36. It should be noted that when locking mechanism 16 is in the locked condition, alarm mechanism 18 is in an armed condition, and when locking mechanism 16 is in the unlocked condition, alarm mechanism in a non-armed condition. Moving the locking mechanism from the unlocked condition to the locked condition simultaneously moves alarm mechanism 18 from the non-alarmed condition to the alarmed condition. Furthermore, moving the locking mechanism 16 from the locked condition to the unlocked condition simultaneously moves alarm mechanism from the armed condition to the unarmed condition.

Locator 92 comprises an insert that is configured to be received in aperture 30 and to be sonic welded or otherwise secured to front wall 20*a* of jacket 12. Locator 92 includes a generally D-shaped base 98 that is sized to be received in aperture 30 and to abut shoulder 21 of front wall 20*a*. A region 98*a* of base 98 extends beyond shoulder 21 and terminates substantially flush with an interior surface of front wall 20*a*, as is best seen in FIG. 7. A first guide wall 100 extends outwardly from region 98*a* and is disposed generally at right angles thereto. First guide wall 100 is generally rectangular in cross-sectional shape. A second guide wall 102 extends outwardly from region 98*a* of base 98 a spaced distance from first guide wall 100 Second guide wall 102 has a truncated triangular shape when viewed in cross-section and, in particular includes an angled surface 102*a* so that second guide wall 102 tapers away from base 98. Both of first and second guide walls 100, 102 run substantially the entire length of base 98. A channel 104 is defined between first and second guide walls 100, 102 and runs substantially the entire length of base 98. Channel 104 is of a sufficient width to receive a portion of left side wall 34*c* of sleeve 14 therein when sleeve and jacket 12 are engaged with each other. Angled surface 102*a* on second guide wall 102 is angled in such a manner that channel 104 is wider proximate the outer ends of first and second guide walls 100, 102 and is narrower proximate base 98. Angled surface 102*a* acts to capture and guide the portion of the left side wall 34*c* of sleeve 14 into channel 104 when sleeve 14 and jacket 12 are engaged with each other.

Locator 92 includes two spaced apart indents 94 defined in the outer surface of base 98 and disposed adjacent one side edge thereof. When locator 92 is engaged in aperture 30, the side edge with the indents 94 is disposed adjacent corner 26 of jacket 12. When locator 92 is so engaged in aperture 30, indents 94 align with notches 31 on corner 26 of jacket 12. Indents 94 are provided to show a store employee where to position the specially designed magnetic key "K" (FIG. 10) in order to disengage the locking mechanism 16. Indents 94 preferably are D-shaped as they are configured to be complementary to special projections on the key "K". It will, of course, be understood that any other type or shape of indicator other than indents 94 may be provided on locator 92 of jacket 12. Additionally, any differently configured locator may be used on jacket 12 instead of the locator 92.

Referring to FIGS. 9-13, security container 10 is used in the following manner. Sleeve 14 is inserted into jacket 12 by placing bottom end 14*b* thereof into the opening of cavity 22 defined by edge 24 of jacket 12. Sleeve 14 is oriented so that catch 46 will contact the inner surface of front wall 20*a* and will be forced inwardly into depression 44 so that sliding motion is possible between sleeve 14 and jacket 12. A product "P" is placed into chamber 36 within sleeve 14. Product "P" is placed on an uppermost surface of intermediate wall 34*f* and is oriented thereon so that its display side 106 (such as a side with a logo thereon) faces toward window 38.

Once product "P" is correctly positioned, sleeve 14 is pushed downwardly in the direction of arrow "A" (FIG. 11) toward bottom wall 20*b* of jacket 14. This downwardly movement causes catch 46 to be moved inwardly toward depression 44 as the angled wall 58*b* (FIG. 4) thereon engages the portion of front wall 20*a* that defines the bottom end of slot 28. As catch 46 moves into depression 44, spring 50 is depressed. As sleeve 14 continues to move downwardly through cavity 22 in the direction of arrow "A", a portion of left side wall 34*c* slides into the upper end of channel 104 in locator 92. This engagement ensures that locking mechanism 16 will be correctly positioned for unlocking with the key "K" at a future time. Sleeve 14 continues to move downwardly through cavity until bottom wall 36*b* of sleeve 14 is disposed adjacent the interior surface of bottom wall 20*c* of jacket 12. At this point, the top 14*a* of sleeve 34*a* is substantially coplanar with upper edge 24 of jacket 12, i.e., the exterior surface of top wall 34*a* of sleeve 14 is disposed substantially coplanar with upper edge 24. Flanges 37 on sleeve 14 are received in notches 25 of jacket 12.

As sleeve 14 and jacket 12 move into this orientation relative to each other, spring arms 90*a*, 90*b* of spring clip are disposed adjacent to first and second pockets 86, 88. Because spring arms 90*a*, 90*b* are spring biased, when they are adjacent first and second pockets 86, 88 the spring arms 90*a*, 90*b* move out of alignment with planar member 90*c* and into pockets 86, 88 and become seated therein. If an attempt is made to move sleeve 14 relative to jacket 12 in a direction opposite to arrow "A", then the free ends of spring arms 90*a*, 90*b* will engage the faces of 78*a*, 80*a* of horizontal members 78, 80 and thereby substantially prevent further longitudinal movement of sleeve 14. At this point, locking mechanism 16 is in a locked condition (FIG. 9)

Movement of sleeve 14 from a first position (FIG. 11) to a second position (FIG. 13) and movement of locking mechanism 16 from an unlocked condition to a locked condition also simultaneously closes an electric circuit (not shown) within security container 10 which in turn causes the alarm mechanism 18 to move from an unarmed condition to an armed condition. The wiring of security container 10 has not been shown in the attached drawings to simplify the same, but the wiring of such a device would be within the skill of one of ordinary skill in the art.

Locking mechanism 16 and alarm mechanism 18 can only be deactivated using the specially designed separate magnetic key "K". The key "K" in question could be substantially identical to the magnetic key described in U.S. Pat. No. 7,453,370 to Marsilio. The key "K" will need to include component parts that are configured to be seated in indents 94 on locator 92 and to thereby bring the magnet(s) "M" in the key "K" into the correct position to influence the magnetic spring arms 90*a*, 90*b* on spring clip 90. The magnetic field of the key "K" will cause spring arms 90*a*, 90*b* to move out of first and second pockets 86, 88 in the directions of arrow "B" (FIG. 10) and back into alignment with the planar member 90*c* of spring clip. When this occurs, the user is able to slide sleeve 14 upwardly in the direction of arrow "C" (FIG. 12), thus sliding sleeve 14 at least partially out of cavity 22 of jacket 12. The key "K" can be disengaged from locator 92 as soon as spring arms 90*a*, 90*b* have cleared pockets 86, 88. The unlocking of locking mechanism 16 also simultaneously breaks a circuit to alarm mechanism 18, thus disarming the alarm and moving the alarm mechanism back to an unarmed condition.

Figure 12:
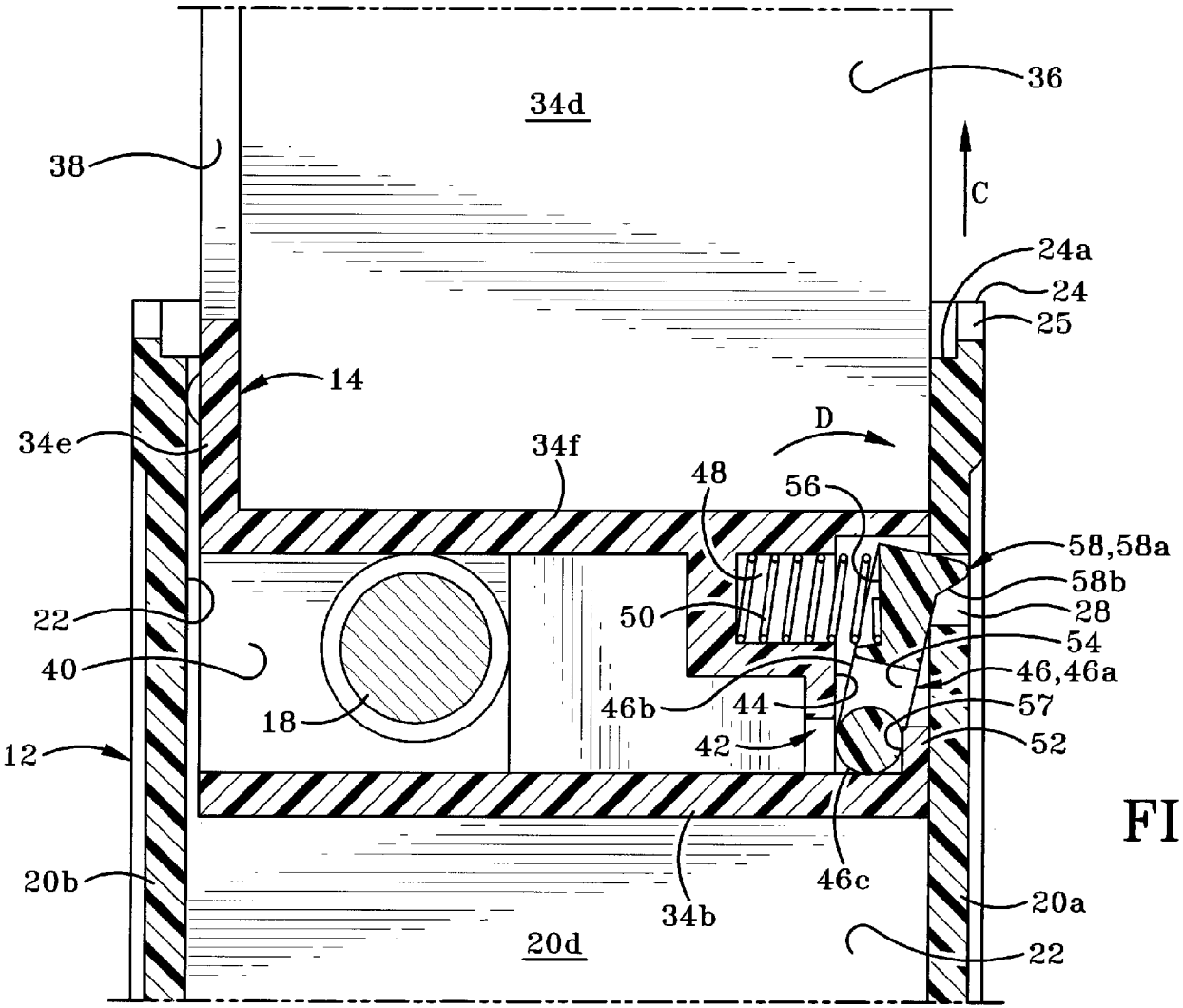
FIG. 12 is a left-side cross-sectional view of the security container taken through line 12-12 of FIG. 11, showing the catch engaged in the slot and preventing withdrawal of the sleeve from the cavity of the jacket.
Figure 13:
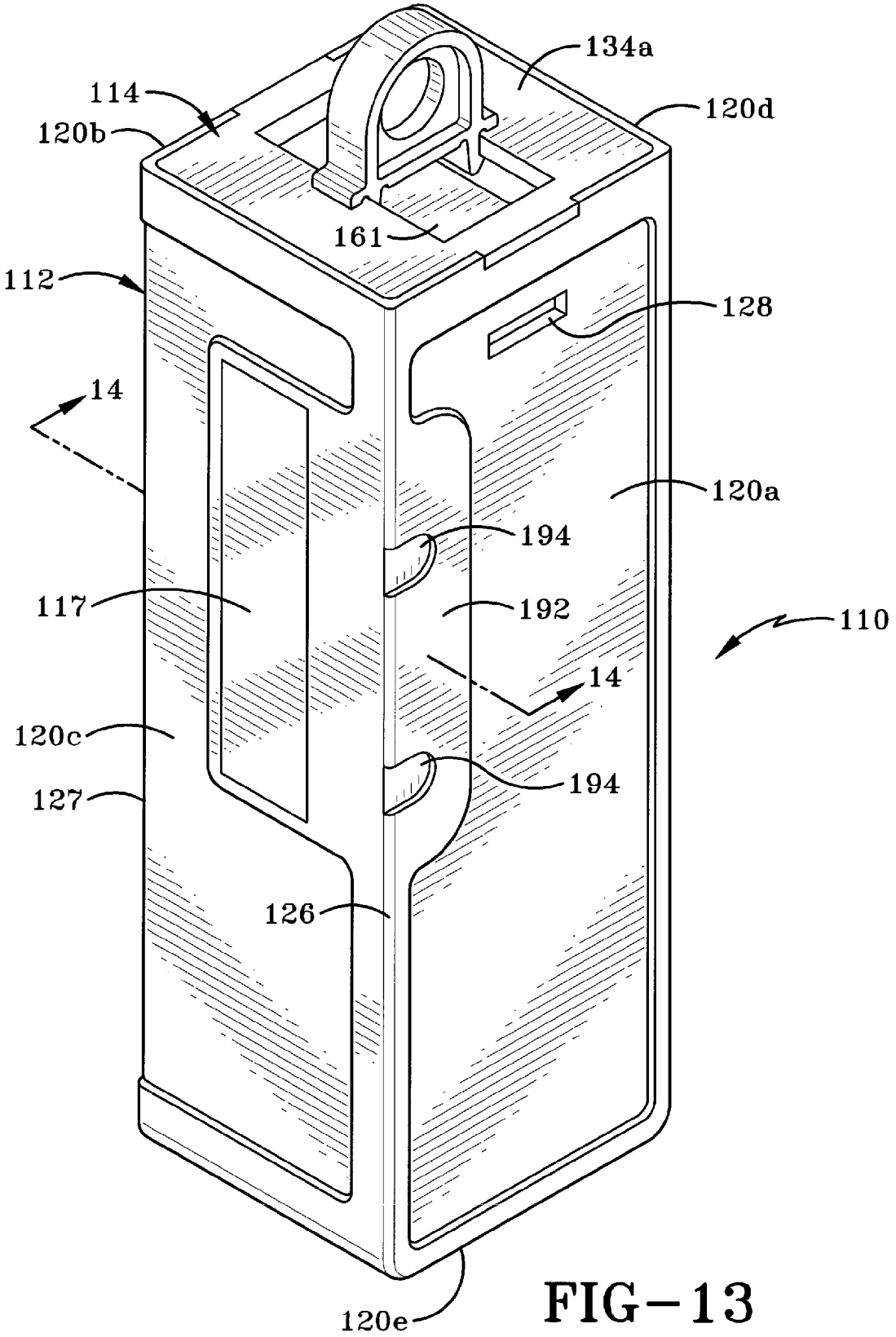
FIG. 13 is a perspective front view of a second embodiment of a security container in accordance with the present invention, show in a locked condition.
Figure 14:
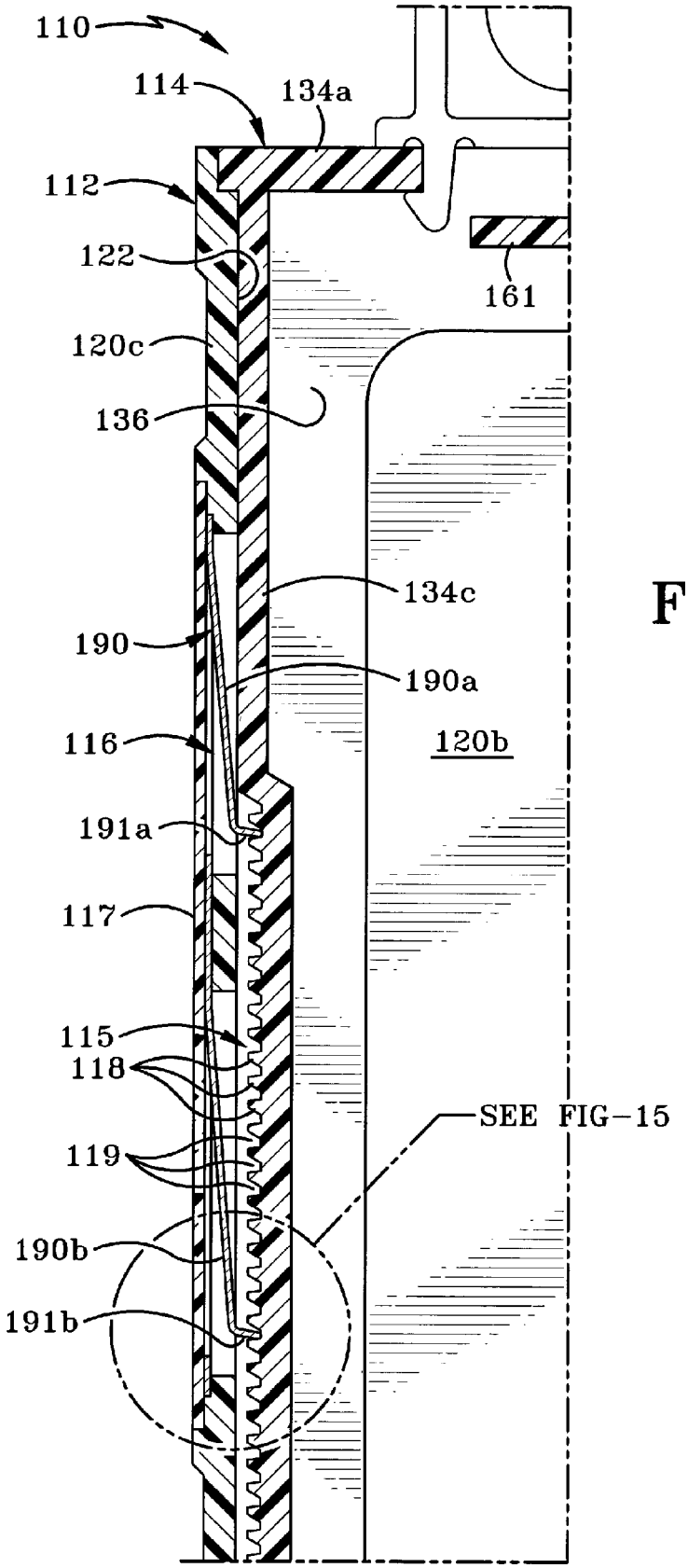
FIG. 14 is a left-side cross-sectional view of the security container taken along line 14-14 of FIG. 13 and showing the second embodiment of a locking mechanism which enables the overall length of the security container to be changed.

Sleeve 14 is able to be moved upwardly until projection 58 on catch reaches slot 28 in front wall 20*a* of jacket 12. When this occurs, the spring 50 moves from the condition shown in FIG. 8 to its original, uncompressed state (FIG. 12) causing catch 46 to rotate on its curved end 46*c* within channel 57. This causes projection 58 to be pushed forwardly and into slot 28 as shown in FIG. 12. The engagement of projection 58 in slot 28 substantially prevents any further movement in the direction of arrow "C". Thus, sleeve 14 and jacket 12 remain engaged with each other at all times.

Once the user is able to access chamber 36 within sleeve 14, the product "P" may be removed therefrom and security container 10 is able to be recycled. Another product (not shown) can be inserted into chamber 36 so that its front surface faces window 38. The user depresses projection 58 on catch 46 inwardly to remove it from slot 28 and simultaneously pushes sleeve 14 downwardly in the direction of arrow "A" and back into cavity 22. The movement is continued until locking mechanism 16 moves back into a locked condition and alarm mechanism 18 is re-armed. As indicated previously, if an authorized person attempts to tamper with security container 10 when in this alarmed state or attempts to remove the same from a store without application of the special magnetic key "K", the alarm mechanism 18 will be activated and will alert store personnel to the tampering or attempted theft incident.

Security container 10 may be suspended from a display rod (not shown) when hanger 64 is snap-fitted into top wall 34*a* of sleeve 14. This is accomplished by inserting hook ends of legs 68 into channels 62 in top wall 34*a* of sleeve and pushing downwardly thereon. Inclined surfaces 68*a* allow the hook ends of legs 68 to slide readily into one of channels 62. As inclined surface 68*a* engages the side edge of recessed wall 61, leg 68 is caused to flex inwardly away from wall 61, allowing the hook end to slide into channel 62. Once flat region 68*b* on leg 68 clears the innermost surface of edge 63 of top wall 34*a*, leg 68 returns to its original position and snaps into abutting contact with side edges of recessed wall 61, locking hanger member 64 into engagement therewith. The display rod may then be inserted through aperture 70.

It will be understood that hanger member 64 may be omitted from security container 10 or may be detached therefrom. In order to detach hanger member 64 from its engagement with security container 10, a store employee engages outer side edges of flanges 69 and then pinches them toward each other. This movement causes hanger member 64 to flex at grooves 72, moving legs 68 to a position where the hooked ends will disengage from edges 63 of top wall 20*a*. Legs 68 may then be withdrawn from channels 62, thus disengaging hanger member 64 from sleeve 14. Security container 10 is then able to be positioned on a display shelf (not shown) and may do so resting on any of the jacket's exterior walls or even on top wall 20*a* of sleeve 14. The two channels 62 pose no risk for entry into chamber 36 to access product "P" as they are simply too small. A would-be thief also cannot disarm the alarm mechanism 18 through channels 62 as this mechanism 18 is situated on the opposite end of sleeve 14 from channels 62.

Referring to FIGS. 13-16 there is shown a second embodiment of the security container in accordance with the present invention, generally indicated at 110. One feature that is different about security container 110 with respect to container 10 is that this second embodiment is adjustable in overall length. Security container 10 is of a length "L" (FIG. 1) that is substantially equal to the length of jacket 12. Security container 110, on the other hand, is of a minimum length "L" and may be adjusted to a maximum length equal to the length "L"+"L1" shown in FIG. 16. Neither of the lengths "L" nor "L1" include the height of the hanger member 64, 164.

Security container 110 is comprised of an outer jacket 112 and an inner sleeve 114. Jacket 112 includes a front wall 120*a*, a back wall 120*b*, a left side wall 120*c*, a right side wall 120*c*, and a bottom wall 120*e*. The front, back, left side, right side and bottom walls bound and define a cavity 122 (FIG. 14) into which sleeve 114 is longitudinally, slidably received in much the same manner as jacket 12 and sleeve 14. Jacket 112 is substantially identical to jacket 112 except for a few features. Firstly, the structure of locking mechanism 116 and the location of the same on security container 110 differs from locking mechanism 16 and its location on security container 10. In jacket 12, shown in FIG. 1, the locking mechanism 16 is positioned beneath a plate 17 located adjacent corner 26 of jacket 12. In jacket 112, shown in FIG. 13, the locking mechanism 116 is positioned beneath a plate 117 located roughly midway between corners 126 and 127 on left side wall 120*c* of jacket 112. During manufacture an aperture may be formed in left side wall 134*c* of jacket 112 and spring clip 190 be secured to plate 117 which is then sonic welded into the aperture so that spring arms 190*a*, 190*b* project into cavity 122. Spring clip 190 (FIG. 14) forms part of locking mechanism 116 and is secured to the interior surface of left side wall 120*c* of jacket 114. Spring clip 190 is substantially identical to spring clip 90 except that each of its first arm 190*a* and second arm 190 (which are movable relative to the planar member thereof) terminates in a hook 191*a*, 191*b* instead of simply being straight. The purpose of the hooks 191*a*, 191*b* will be described hereafter.

Figure 16:
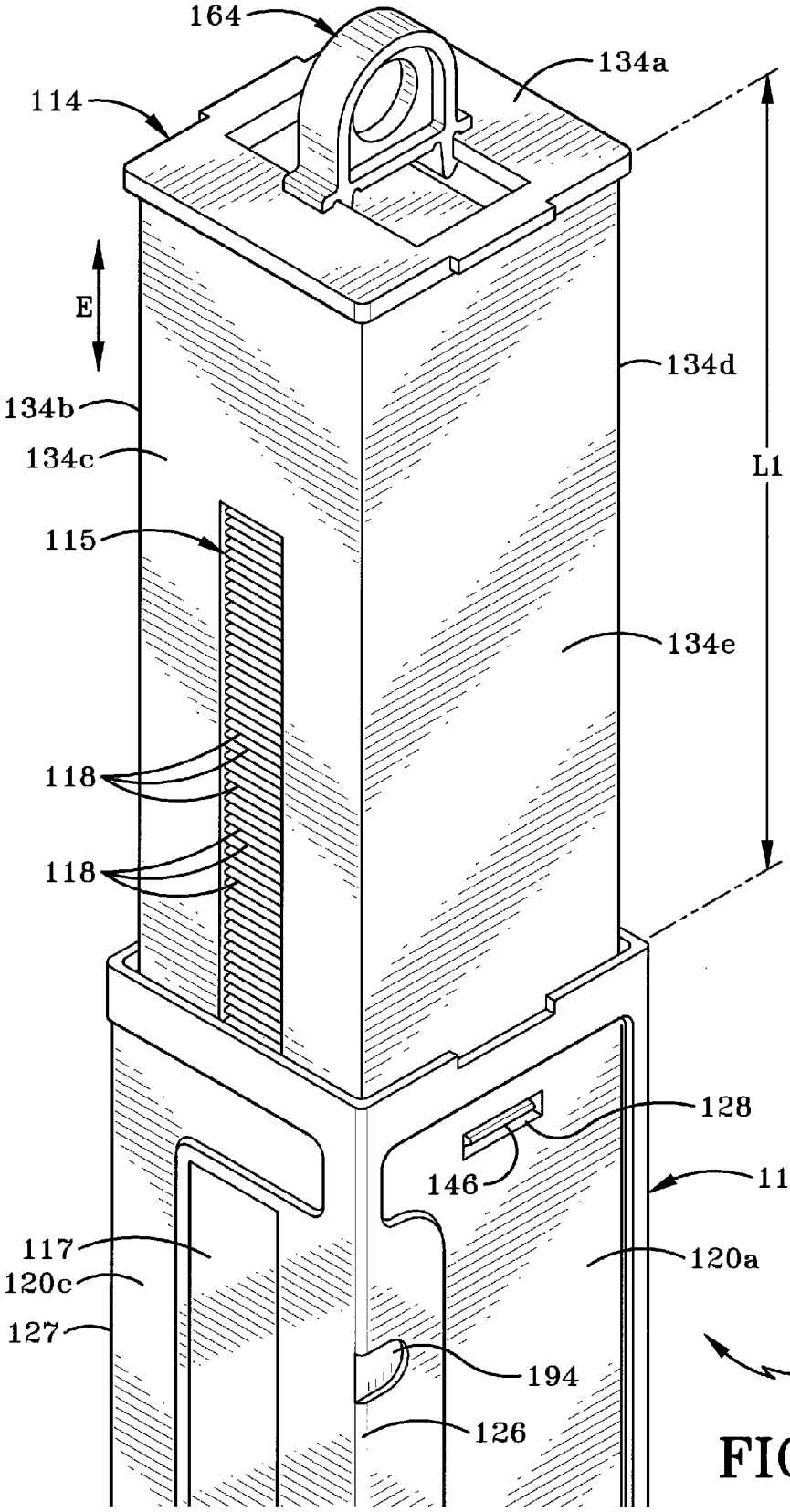
FIG. 16 is a perspective front view of the security container shown adjusted to a longer overall length to accommodate a longer product. Similar numbers refer to similar parts throughout the drawings.

Sleeve 114 differs from sleeve 14 in a number of ways. Firstly, as shown in FIG. 16, sleeve 114 has a top wall 134*a*, a back wall 134*b*, a left side wall 134*c*, and a right side wall 134*d*. Sleeve 114 also has a front wall 134*e* and, even though it is not shown in the attached figures, sleeve 114 does not have a bottom wall. Furthermore, sleeve 114 does not have an intermediate wall and a compartment which houses all of the security components. Preferably, the intermediate wall and the compartment which houses all of the security components are identical to wall 34*f* and compartment 40 of sleeve 14 but are located in the interior bottom end of jacket 112 above the interior surface of bottom wall 20*b*. Still further, a recessed region (not shown) is defined in front wall 134*e* of sleeve 114 proximate a bottom end thereof. The recessed region defines a depression in which catch 146 is engaged. Each of the recessed region, the depression and the catch 146 are substantially identical in structure and function to recessed region 44, 52, 48 and catch 46 on security container 10. Catch 146 is engageable in slot 128 in front wall 134*a* of jacket 112 to keep sleeve 114 from being disengaged from jacket 112 unless and until it is desirable to do so.

Figure 15:
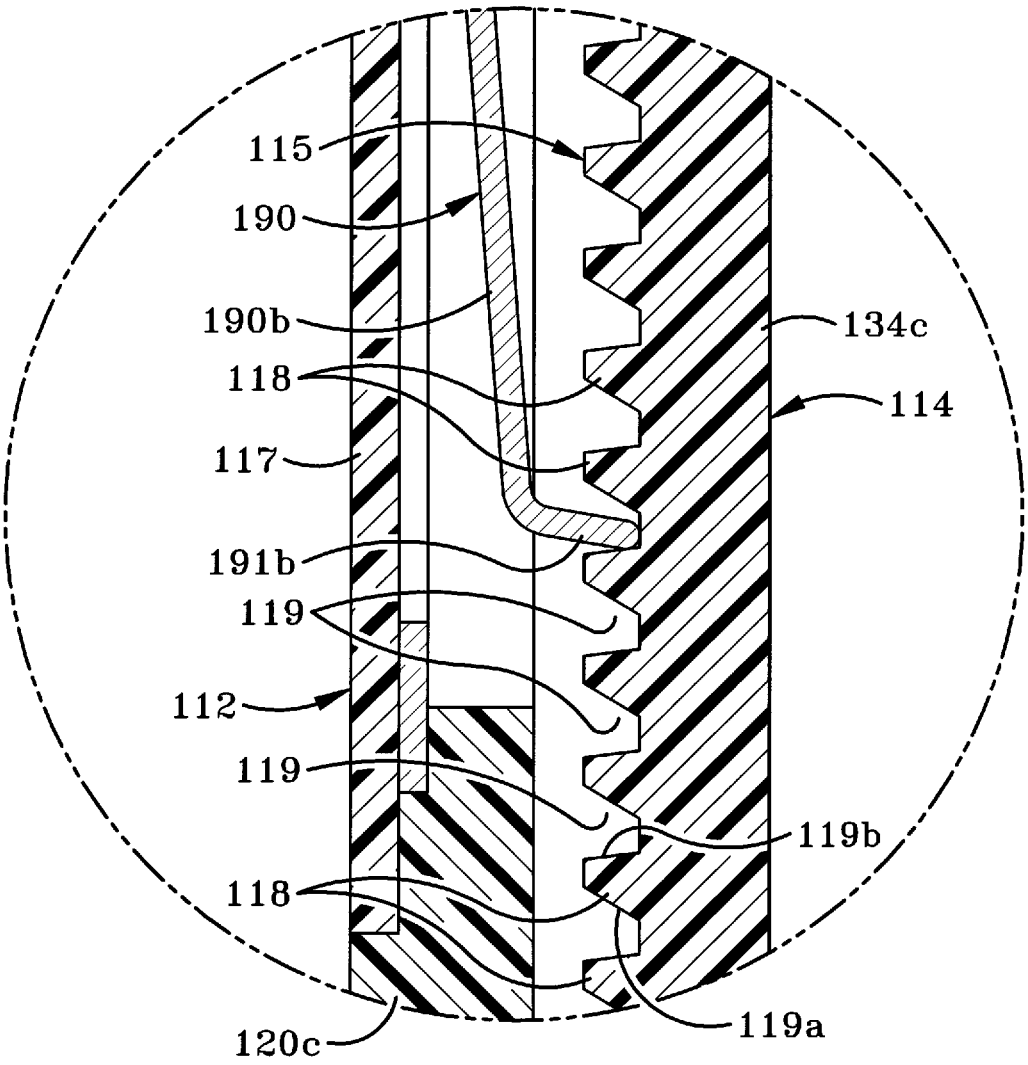
FIG. 15 is an enlargement of the highlighted region of FIG. 14 showing the hooked end of the arm of the spring clip locking member engaged with a rack disposed on the side wall of the sleeve.

In accordance with a specific feature of the present invention, locking mechanism 116 further includes a rack 115 which is provided on an exterior surface of left side wall 134*c* of sleeve 114. Rack 115 is configured to be engageable with spring clip 190. Preferably, rack 115 extends longitudinally generally along a midline of left side wall 134*c*. This location makes the operation of locking mechanism 116 more stable than if the rack 115 is situated adjacent one or the other corners 126, 127. Rack 115 and spring clip 190 are positioned in complementary locations on jacket 112 and sleeve 114. As best seen in FIG. 15, rack 115 includes a plurality of horizontally oriented teeth 118 thereon. Adjacent teeth 118 are separated from each other by a trough 119. As is evident from FIG. 15, hooked ends 191*a*, 191*b* of spring clip 190 are selectively engageable in any one of the plurality of troughs 119 on rack 115. Each tooth 118 has an angled face 119*a* and a straight face 119*b*. The orientation of the straight faces 119*b* and the angled faces 119*a* is such that movement of the sleeve 114 in the direction downward direction to reduce the size of security container 110 is relatively easy. Teeth 118 substantially prevent upward movement to increase the length of security container without first moving hooked ends 191*a*, 191*b* of spring clip 190 out of troughs 119. The teeth 118 thereby lock sleeve 114 to jacket 112 to prevent sleeve 114 from being withdrawn from cavity 112 to access the product. When it is desired to detach sleeve 114 from jacket 12, teeth 118 must be withdrawn from the troughs 119. This is accomplished by engaging the specially configured magnetic key "K" (shown in FIG. 10) in the indents 194 on locator 192. Locator 192 functions in the same manner as locator 92 in security container 10. Once the tips of hooked ends 191*a*, 191*b* of spring clip 190 clear the outermost ends of teeth 118, sleeve 114 may be slid longitudinally relative to jacket 112 in either direction, as is indicated by arrow "E" (FIG. 16). It will be understood that locator 192 may be positioned in any other location on security container 110 that will enable the specially designed magnetic key "K" to attract the magnetic spring arms 190*a*, 190*b* of spring clip 190 out of the troughs 119 of rack 115, without departing from the scope of the present invention. Locator 192 may be configured to be substantially identical to locator 92 where it acts both to guide the travel of sleeve 14 relative to jacket 12. Alternatively, locator 192 may simply be a planar component that is secured to the exterior surface of jacket 114 in an appropriate location such that the indents 194 thereon are correctly positioned to align the magnets "M" in key "K" with spring arms 190*a*, 190*b* of spring clip 190.

Security container 110 is used in the following manner. Initially, it is necessary to access to the chamber 136 (FIG. 14) in order to insert a product into the same. Since sleeve 114 includes top, back, front, left and right side walls 134*a*-134*e* it is necessary to completely detach sleeve 114 from jacket 112. In order to do this, the projection (not numbered but the equivalent of projection 58 on catch 46) is pushed inwardly through slot 128 so that it moves back toward the interior of security container 110. Once the projection is clear of slot 128, sleeve 11 is pulled upwardly to separate sleeve 114 from jacket 112. A product (not shown) is then inserted into cavity 122 of jacket 112 and sleeve is engaged with jacket 112 to enclose the product within the interior formed by cavity 122 and chamber 136. Sleeve 114 is slid longitudinally into cavity 122 to a sufficient degree that at least the catch 146 engages in slot 128. Catch 146 is then disengaged once again from slot 128 and sleeve 114 is moved inwardly until the interior surface of recessed wall 161 (FIG. 14) is disposed adjacent a top end of the product. Hanger member 164 may be engaged with sleeve 114 or may be omitted from security container 110 as was described with reference to hanger member 64 and security container 10. As with security container 10, security container 110 may include a number of transparent walls in jacket 112 and sleeve 114 so the product may be seen by the consumer.

A third embodiment of the present invention is contemplated but not illustrated herein. In this third embodiment, the security container is substantially identical to security container 10 but includes the placement of the locking mechanism in a location substantially identical to that of security container 110. The sleeve and jacket of this third embodiment are substantially identical to the sleeve 14 and jacket 12, with the exception that the window in the sleeve of the third embodiment is substantially smaller than the window 38. In particular, the window in the third embodiment originates a greater distance away from the top wall of the sleeve. This increased distance is specifically selected so that it is impossible to gain access into the interior chamber of the sleeve of this third embodiment security container when the locking mechanism is utilized to increase the overall length of the combined sleeve and jacket. All other components are substantially identical in structure and function to those particular components in one or both of security containers 10, 110.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A security container for holding a product, comprising;

a jacket having a jacket longitudinal axis, a cavity defined in the jacket, a sleeve configured to be complementary to the cavity and being selectively receivable therein, the sleeve having a sleeve longitudinal axis;

a chamber defined in the sleeve, said chamber being adapted to receive the product therein; and wherein said sleeve is movable within the cavity between a first position where a user is able to access the chamber, and a second position where a user is not able to access the chamber;

a locking mechanism movable between an unlocked condition where the sleeve is movable between the first and second positions, and a locked condition where the sleeve is in the second position and substantially no movement is possible between the sleeve and jacket; and an alarm mechanism movable between an alarmed condition and a non-alarmed condition, and when the locking mechanism is in the locked condition the alarm mechanism is in the alarmed condition, and when the locking mechanism is in the unlocked condition, the alarm mechanism is in the non-alarmed condition, wherein the movement of the sleeve within the cavity from the first position to the second position comprises the sleeve sliding along the sleeve longitudinal axis in a direction parallel to the jacket longitudinal axis.

2. The security container as defined in claim 1, wherein the jacket and sleeve are adjustably engageable with each other so that the overall length of the combined jacket and sleeve is variable in accordance with the size of the product to be retained in the chamber of the sleeve.

3. The security container as defined in claim 1, wherein the sleeve further includes:

a first end wall; and a peripheral wall extending outwardly from the first end wall and generally at right angles thereto; and wherein the chamber is defined by the first end wall and the peripheral wall.

4. The security container as defined in claim 3, wherein the jacket further includes:

an end wall;

a peripheral wall extending outwardly from the end wall and generally at right angles thereto; and wherein the cavity is defined by the end wall and the peripheral wall; and wherein the peripheral wall of the sleeve is received within the cavity defined by the peripheral wall of the jacket; and wherein the peripheral wall terminates in an edge disposed remote from the end wall.

5. The security container as defined in claim 4, wherein the first end wall of the sleeve is substantially flush with the edge of the jacket's peripheral wall when the sleeve is in the second position.

6. The security container as defined in claim 4, wherein when the sleeve is in the second position, a region of the sleeve's peripheral wall extends outwardly from the edge of the jacket's peripheral wall, and the first end wall of the sleeve is disposed a distance beyond the jacket's edge.

7. The security container as defined in claim 4, wherein the sleeve further includes:

a second end wall disposed at an opposite end of the peripheral wall from the first end wall;

an intermediate wall engaged with the peripheral wall and disposed between the first and second end walls; and wherein the chamber for the product is bounded and defined by the first end wall, the intermediate wall and a portion of the peripheral wall extending between the first end wall and the intermediate wall; and a compartment is defined between the intermediate wall and the second end wall; and said compartment is adapted to house components of the alarm mechanism therein.

8. The security container as defined in claim 7, wherein an exterior surface of the second end of the sleeve is in abutting contact with an interior surface of the end wall of the jacket when the sleeve is in the second position.

9. The security container as defined in claim 4, wherein the sleeve further comprises:

a window defined in the peripheral wall, said window being in communication with the chamber.

10. The security container as defined in claim 9, wherein at least a region of the peripheral wall of the jacket is made from a transparent material and the transparent region of the jacket's peripheral wall is aligned with the window in the sleeve when the sleeve is in the second position.

11. The security container as defined in claim 1, wherein the jacket further comprises a guide positioned in the cavity to engage a wall of the sleeve so as to maintain alignment between the sleeve and jacket when the sleeve is moved between the first and second positions.

12. The security container as defined in claim 11, wherein the jacket includes:

a peripheral wall;

an aperture is defined in the peripheral wall; and wherein the guide includes:

a base member which is received in the aperture and is secured to the peripheral wall, and the base member includes:

at least one indicator on an exterior surface of the base member and the at least one indicator is adapted aid in the positioning of a magnetic key for moving the locking mechanism from the locked condition to the unlocked condition.

13. The security container as defined in claim 1, further comprising:

a catch disposed on one of the sleeve and jacket; and a slot defined in the other of the sleeve and jacket; and wherein the catch is engageable with the slot to substantially prevent complete withdrawal of the sleeve from the cavity in the jacket when the sleeve is in the second position.

14. The security container as defined in claim 1, further comprising a hanger member detachably engageable with one of the sleeve and jacket, and when the hanger member is so engaged the security container is adapted to be suspended from a display rod, and when the hanger member is detached from the one of the sleeve and jacket, the security container is not suspendable from a display rod.

15. The security container as defined in claim 1, wherein the alarm mechanism is simultaneously engaged with the locking mechanism and the alarm mechanism is simultaneously disengaged with the locking mechanism.

16. The security container as defined in claim 1, wherein the locking mechanism compnses:

a magnetic locking member provided on one of the sleeve and jacket, where the magnetic locking member is adapted to be unlocked only by means of a magnetic key complementary configured to the magnetic locking member; and an engagement means provided on the other of the sleeve and jacket; and wherein the magnetic locking member engages the engagement means to lock the locking mechanism and disengages from the engagement means to unlock the locking mechanism.

17. The security container as defined in claim 16, wherein the locking member comprises:

a planar base; and a spring biased arm movable into and out of alignment with the base; and the engagement means comprises:

a depression formed in a peripheral wall of the one of the sleeve and jacket;

a ridge disposed at right angles to the jacket longitudinal axis; and when the locking mechanism is moved into the locked condition, the arm moves into the depression and an end of the arm engages the ridge substantially preventing further longitudinal movement of the sleeve relative to the jacket.

18. The security container as defined in claim 17, wherein the locking member comprises:

a planar base;

a spring biased arm movable into and out of alignment with the base; and the arm has a terminal end that is disposed at an angle relative to the rest of the arm; and wherein the engagement means comprises:

a rack of alternating teeth and troughs, said rack being disposed longitudinally along a peripheral wall of the one of the sleeve and jacket, and wherein the teeth and the troughs are all disposed at right angles to the jacket longitudinal axis; and when the locking mechanism is moved into the locked condition, the arm moves out of alignment with the planar base and the terminal end of the arm moves into one of the troughs on the rack substantially preventing further longitudinal movement of the sleeve relative to the jacket in one direction.

19. The security container as defined in claim 18, wherein the overall length of the container is adjustable by sliding the sleeve further inwardly into the cavity of the jacket or further outwardly from the cavity of the jacket and selectively engaging the terminal end of the arm on the locking member in one of a number of different troughs on the rack.

* * * * *